US011906257B2

(12) United States Patent
Thimm et al.

(10) Patent No.: US 11,906,257 B2
(45) Date of Patent: Feb. 20, 2024

(54) CONTROL ELEMENT, BREECHBLOCK STOP LEVER, BREECHBLOCK CARRIER, TRIGGER, TRIGGER ASSEMBLY FOR AN AUTOMATIC WEAPON, AND AN AUTOMATIC WEAPON EQUIPPED THEREWITH

(71) Applicant: HECKLER & KOCH GmbH, Oberndorf (DE)

(72) Inventors: Stefan Thimm, Hardt (DE); Markus Hetzel, Epfendorf-Talhausen (DE)

(73) Assignee: HECKLER & KOCH GmbH, Oberndorf (DE)

( * ) Notice: Subject to any disclaimer, the term of this patent is extended or adjusted under 35 U.S.C. 154(b) by 0 days.

(21) Appl. No.: 17/675,656

(22) Filed: Feb. 18, 2022

(65) Prior Publication Data

US 2022/0325970 A1 Oct. 13, 2022

(30) Foreign Application Priority Data

Feb. 18, 2021 (DE) ..... 10 2021 103 878.2

(51) Int. Cl.
*F41A 17/42* (2006.01)
*F41A 17/58* (2006.01)
*F41A 19/10* (2006.01)

(52) U.S. Cl.
CPC ..... *F41A 17/42* (2013.01); *F41A 17/58* (2013.01); *F41A 19/10* (2013.01)

(58) Field of Classification Search
CPC ..... F41A 17/42; F41A 17/58; F41A 19/10; F41A 19/12; F41A 19/33; F41A 19/46
(Continued)

(56) References Cited

U.S. PATENT DOCUMENTS 2,436,175 A 2/1948 Neal
3,051,056 A * 8/1962 Kuijvenhoven ..... F41A 19/03 89/140

(Continued)

FOREIGN PATENT DOCUMENTS

DE 10 2007 004 588 7/2008
DE 10 2007 052 105 5/2009

(Continued)

OTHER PUBLICATIONS

German Patent Office, "Office Action", issued in connection with German Patent Application No. 110 2021 103 878.2, dated Sep. 21, 2021, with English Translation, 75 pages.

(Continued)

*Primary Examiner* — Bret Hayes
(74) *Attorney, Agent, or Firm* — Hanley, Flight & Zimmerman, LLC

(57) ABSTRACT

One example control element for controlling a breechblock stop lever that can move about a first axis of rotation, which can be moved between a standby position for releasing a breechblock carrier and a retaining position for retaining the breechblock carrier, includes a first arm (15) that can rotate about a second axis of rotation (B), a first control section on the first arm, the first control section including a first contact surface (11*a*) and a second contact surface (11*b*) facing away from the first contact surface (11*a*), which can be rotated about the second axis of rotation (B) for the control element (10) by a control curve (36, 37, 38) on the breechblock carrier (30); and a second control section (13) on the first arm, wherein the second control section can be controlled by a control surface (55*a*) on a trigger (50). Other examples are possible.

6 Claims, 26 Drawing Sheets

(58) Field of Classification Search
USPC ..... 89/142, 144, 148, 149, 150
See application file for complete search history.

(56) References Cited

U.S. PATENT DOCUMENTS

| | | | | |
|---|---|---|---|---|
| 4,433,610 | A | 2/1984 | Tatro | |
| 4,448,109 | A | 5/1984 | Johnson | |
| 4,523,510 | A | 6/1985 | Wilhelm | |
| 6,510,778 | B1 | 6/2003 | Irwin | |
| 7,398,723 | B1 * | 7/2008 | Blakley | F41A 19/10 89/129.01 |
| 8,042,450 | B2 | 10/2011 | Doll et al. | |
| 8,220,192 | B2 | 7/2012 | Fluhr et al. | |
| 9,222,746 | B2 | 12/2015 | Doll et al. | |
| 2007/0051236 | A1 | 3/2007 | Groves et al. | |
| 2009/0107024 | A1 | 4/2009 | Doll et al. | |
| 2010/0257769 | A1 | 10/2010 | Doll | |
| 2011/0168008 | A1 | 7/2011 | Landies et al. | |
| 2015/0089854 | A1 | 4/2015 | Findlay | |
| 2015/0168091 | A1 * | 6/2015 | Doll | F41A 19/26 42/69.01 |
| 2015/0292828 | A1 | 10/2015 | Nebeker et al. | |
| 2015/0330734 | A1 | 11/2015 | Kolev et al. | |
| 2018/0023907 | A1 | 1/2018 | Warburton et al. | |
| 2018/0066907 | A1 | 3/2018 | Hefer et al. | |
| 2020/0340771 | A1 | 10/2020 | Shneorson et al. | |
| 2020/0386504 | A1 | 12/2020 | Tubb et al. | |

FOREIGN PATENT DOCUMENTS

| | | | | |
|---|---|---|---|---|
| DE | 10 2012 212 388 | | 1/2014 | |
| DE | 102012212388 | B4 | 8/2014 | |
| EP | 0188179 | B1 * | 11/1990 | F41A 19/15 |
| EP | 2 198 232 | | 6/2010 | |
| EP | 2 205 924 | | 7/2010 | |
| EP | 2 205 925 | | 7/2010 | |
| EP | 2198232 | B1 | 3/2011 | |
| KR | 102202922 | B1 | 1/2021 | |

OTHER PUBLICATIONS

European Patent Office, "Extended European Search Report," issued in connection with Application No. 22157378.5, dated Nov. 8, 2022, 45 pages. [English Machine Translation Included].

Japanese Patent Office, "Notice of the Reasons for Refusal," issued in connection with Japanese Patent Application No. 2022-023629 dated Jul. 4, 2023, 10 pages. [English Translation Included].

Canadian Patent Office, "Office Action," issued in connection with Canadian Patent Application No. 3149528, dated Nov. 28, 2023, 3 pages.

Japanese Patent Office, "Decision to Grant," issued in connection with Japanese Patent Application No. 2022-023629, dated Dec. 12, 2023, 5 pages. [English Translation Included].

* cited by examiner

CONTROL ELEMENT, BREECHBLOCK STOP LEVER, BREECHBLOCK CARRIER, TRIGGER, TRIGGER ASSEMBLY FOR AN AUTOMATIC WEAPON, AND AN AUTOMATIC WEAPON EQUIPPED THEREWITH

CROSS-REFERENCE TO RELATED APPLICATION

This patent application claims the benefit of and priority to German Application No 10 2021 103 878.2 filed Feb. 18, 2021, which is hereby incorporated herein by reference in its entirety.

TECHNICAL FIELD

The present disclosure relates to a control element for controlling a breechblock stop lever that can move about a first axis of rotation, a breechblock stop lever, a breechblock carrier for a breechblock that can move longitudinally in an automatic weapon, and a trigger assembly for an automatic weapon. The disclosure also relates to an automatic weapon equipped with such a control element, and/or breechblock stop lever, and/or breechblock carrier, and/or trigger assembly.

BACKGROUND

Unlike with self-loading firearms, automatic weapons can fire ammunition continuously. Examples of automatic weapons include submachine guns in particular, as well as assault weapons and machine guns.

Control elements for firearms are known in principle. A control element for a rocking lever that moves about a pivot axis and its trigger lever are known from DE 10 2007 004 588 B3.

Breechblock stop levers and breechblock carriers are also known.

Automatic weapons, such as the automatic MG 34 and the MG3 are also known to display the switching states, "safe," and "fully automatic fire." A continuous loading of the automatic weapon MG34 and MG3 is not possible, however, when the safety is on.

There are also automatic weapons, such as the MG4 and MG5, which can be loaded when the safety is on. Neither of these automatic weapons, MG4 or MG5 can be set to a "single shot" mode, however.

A trigger assembly for a firearm, in particular the MG4 and MG5 is known from DE 10 2012 212 388 B4. The trigger assembly comprises a breechblock that can be slid between an initial position and a loading position, a stop lever that can be moved between a standby position for releasing the breechblock and a retaining position for holding the breechblock in place, a trigger element that can move between a non-actuating position and an actuating position, for moving the stop lever from its retaining position to its standby position, a triggering element that can move in relation to the trigger element, which can move between a retaining position for holding the stop lever in its standby position, and a release position for allowing a movement of the stop lever into its retaining position. A movement of the triggering element from its retaining position into the releasing position takes place through contact of the breechblock with the triggering element when it moves toward the loading position. This triggering element can pivot in this case about a pivot axis for the triggering element in relation to the trigger element, such that the triggering element can move out of the movement space of the breechblock when the trigger element is in the non-activated position, by means of a breechblock moving toward the initial position when the safety is on, as well. This results in a trigger assembly, that prevents a blocking of the breechblock moving toward the home position by the triggering element when the trigger is secured.

A trigger assembly for a trigger housing for an M240 automatic weapon is known from US 2011/168008 A1. The trigger assembly for the trigger housing includes a switch that can be accessed on the outside of the trigger housing for switching the automatic weapon between semiautomatic and fully automatic firing.

A safety mechanism for a stop lever in a trigger device on a firearm, in particular an automatic weapon, that has a breechblock and a safety, is also known from EP 2 198 232 B1. The stop lever can be moved between a locking position that holds the breechblock in place and a position that does not hold the breechblock in place. The safety mechanism engages with the safety when it assumes its secured setting, and thus retains the stop lever in its locked position. There is also a spring element between the safety and the stop lever, which exerts a locking force that holds the stop lever in its locked position. The locking force can be adjusted such that it is greater than release force that brings the stop lever out of its locked position, and also allows the stop lever to be deflected by the effect of the returning breechblock, while flexing the spring element.

A stop lever for a trigger device in a firearm that has a breechblock and a safety, in particular an automatic weapon, is also known from EP 2 205 924 B1. The stop lever can be moved between a locking position that holds the breechblock in place and a position that does not lock the breechblock in place. The stop lever includes a safety element that can move in relation to the stop lever between a releasing position and a securing position. The safety element assumes its releasing position when the breechblock engages with the stop lever, when the returning breechblock exerts a regulating action on the safety element toward the back. In the releasing position, the safety element does not engage with the safety, even if it also assumes its secured position, and the stop lever can be brought into its non-locking position. The safety element can also assume its secured position when the breechblock is moving toward the stop lever, if the breechblock exerts a regulating action toward the front on the safety element, and engages with the safety when the safety is on, and it also assumes its secured position, and the stop lever itself is retained in its locked position, wherein the breechblock also engages with a sear formed on the stop lever.

A stop lever for a trigger device in a firearm that has a breechblock and a safety, in particular an automatic weapon, is also known from EP 2 205 925 B1. The stop lever can be moved between a locking position that holds the breechblock in place and a position that does not lock the breechblock in place. The stop lever includes a safety element that can move in relation to the stop lever from a standby position to a secured position, counter to a spring force. The safety element assumes its secured position when the breechblock moves toward the stop lever, if the breechblock exerts a regulating force toward the front on the safety element, and engages with the safety in this position, if the safety is also on, and the stop lever itself is secured in its locking position. The safety element otherwise assumes its standby position, and releases the stop lever.

BRIEF DESCRIPTION OF THE DRAWINGS

Examples disclosed herein are explained in greater detail below in reference to the attached drawings.

The structure and functioning of the control element 10, breechblock stop lever 20, breechblock carrier 30, trigger 50 and the trigger assembly of a firearm that has a breechblock that moves longitudinally in the receiver, or the firearm with at least one of these elements, is explained below in reference to the drawings, which show examples.

Not all of the reference symbols are inserted in all of the figures, for purposes of clarity. The same reference symbols apply, however, to all of the figures.

DETAILED DESCRIPTION

Position terms in this document such as "up," "down," "front," "back," etc. refer to an automatic weapon in which the bore axis is horizontal, and shots are fired toward the front, away from the shooter.

Figure 1:
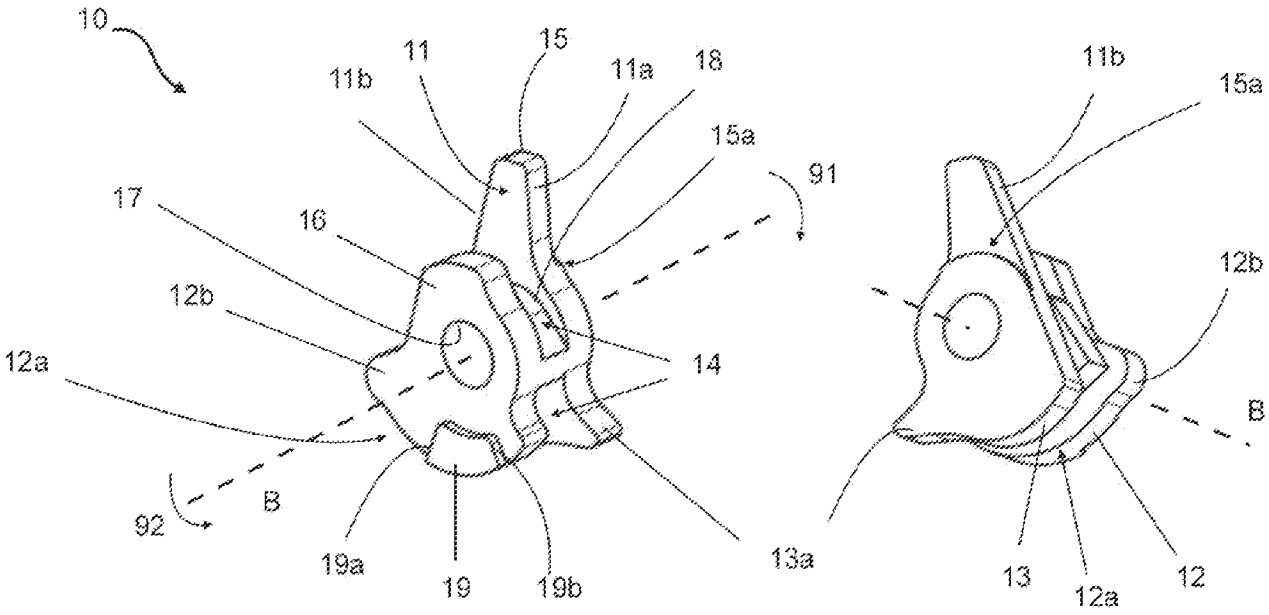
FIG. 1 shows an example control element in a schematic view, from two perspectives.

FIG. 1 shows an example control element 10 in a schematic view from two perspectives. The control element can preferably be used with one or a combination of the assemblies described in greater detail in reference to FIGS. 2, 3, 4, 5 and 6, comprising the breechblock stop lever, breechblock carrier, continuous firing element, and trigger, for a trigger assembly described in greater detail in reference to FIG. 7.

Figure 2:
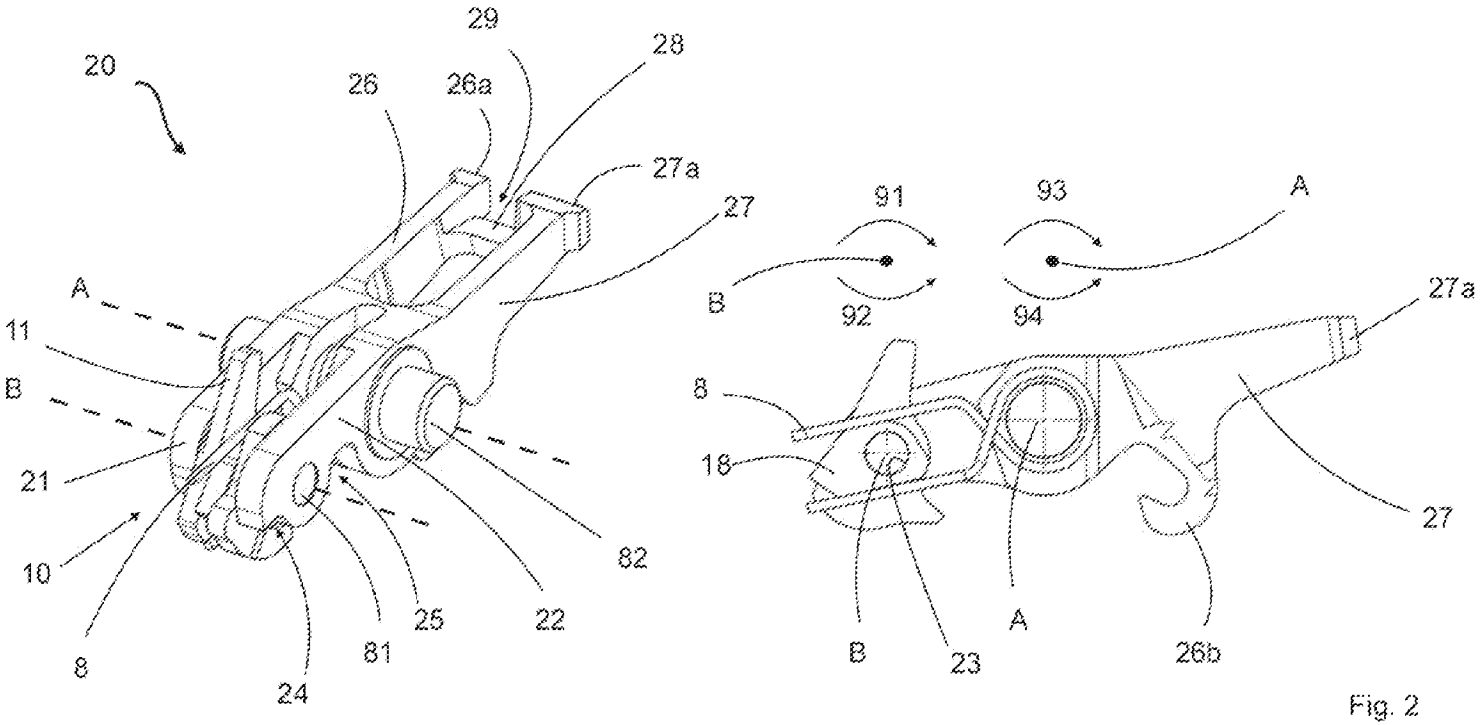
FIG. 2 shows an example breechblock stop lever in a schematic view from two perspectives.

The control element 10 for controlling a breechblock stop lever 20 that can pivot about a first axis of rotation A is described in greater detail in reference to FIG. 2, wherein the breechblock stop lever can move between a standby position for releasing a breechblock carrier that has a control curve and a retaining position for retaining the breechblock carrier.

The control element 10, shown in the form of a pivoting control lever, the axis of which is parallel to the first axis of rotation A for the breechblock stop lever 20, has a second axis of rotation B, and two arms 15, 16, which are axially spaced apart in the direction of the second axis of rotation B.

A middle piece 18 is located between the first arm 15 and second arm 16, which defines an annular gap 14 with the arms 15, 16, that runs at least in part about the axis of rotation B. The legs of a torsion spring can be brought to bear on the middle piece 18 in this annular gap 14, in particular.

A first control section 11 is formed on the first arm 15, which can be pivoted about the second axis of rotation B for the control element 10 by means of the control curve on the breechblock carrier 30. The first control section comprises two contact surfaces 11*a* and 11*b* for this, which can be selectively brought into contact with the control curve. The two contact surfaces 11*a*, 11*b*, face away from one another, and the contact surface 11*b* faces "forward," while the contact surface 11*a* faces "backward."

The cross section of the first arm 15 is tapered from the radial inner end to the radially outer end in the region of the first control section 11. The first arm 15 is also stepped such that a thickness of the first arm 15 in the region of the first control section 11 decreases in the axial direction.

The first control section 11 can also be regarded as a lever arm. In other words, the control element 10, and therefore the first control section 11, or the lever arm, can rotate about the second axis of rotation B in two directions, specifically in a first direction 91 and in an opposing second direction 92.

Figure 6:
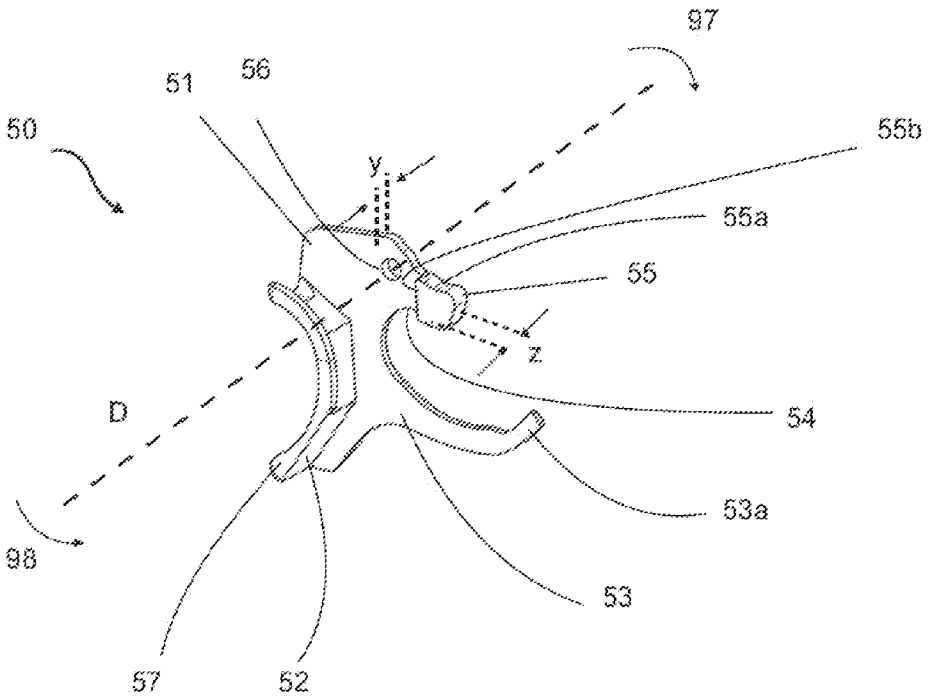
FIG. 6 shows a trigger that can be used in a trigger assembly.

There is also a second control section 13 on the first arm 15, which has a radial projection 13*a* that ends in a point, which can be controlled by a control surface 55*a* and a control edge 55*b* on a trigger 50 described in greater detail in reference to FIG. 6, in order to rotate it with the breechblock stop lever 20 coupled to the control element 10 about the first axis of rotation A. The radial projection 13*a* has an edge that is parallel to the axis of rotation B. The first control section 11 and the second control section 13 are also opposite one another radially.

There is a third control section 12 on the second arm 16, which can be brought into contact with the breechblock stop lever 20. The third control section 12 has a projection 19 that extends in the axial direction, which acts as a claw in the present case. Two contact surfaces 19*a*, 19*b* are formed on the claw, facing the direction of rotation for the control element. The claw 19 is formed on an end surface of the second arm 16 facing away from the first arm 15. The contact surface 19*a* acts in the direction of rotation 91, and the contact surface 19*b* acts in the opposite direction of rotation 92.

The second section 13 has a first region 13*a* that extends radially, which bears on the control surface 55*a*, or control edge 55*b* of the trigger 50. Such an "elongated" control element 10 enables the activation by the trigger 50, as well as the interruption or termination of this activation.

The third control section 12 has a second radial projection 12*a*, which is eccentric or arched, and forms the lower end of the second arm 16, or the third control section 12.

The second radial projection 12*a*, which can also be referred to as a radial downward extension, is used to brace against a non-rotating component, e.g. an element. The radial incline of the end region 12*a* of the third control section 12 is used to further bring the rear first 26 and second 27 stop arm sections of the breechblock stop lever 20 to the standby position when the breechblock moves forward, as shall be explained in greater detail in reference to the following figures.

The eccentric third control section 12 transitions at its left end into another radial projection. Unlike the other projection 13*a*, this radial projection is blunt, or is semicircular, and does not come to a point. This second radial projection serves substantially as a lateral stop to keep the spring element, in particular the torsion spring, from slipping out of the annular gap 14.

The control element 10 also has a hole 17 that is coaxial to the axis of rotation B. In other words, this hole 17 passes through both end surfaces. A fastening element such as a bolt can be received in this hole that then supports the control element 10 on the breechblock stop lever 20.

Such a control element 10 can hold the breechblock stop lever 20 in its standby position through the control of the breechblock carrier 30 when the breechblock carrier is moving forward, and allow the breechblock stop lever to rotate in this position during the return of the breechblock carrier.

Figure 1A:
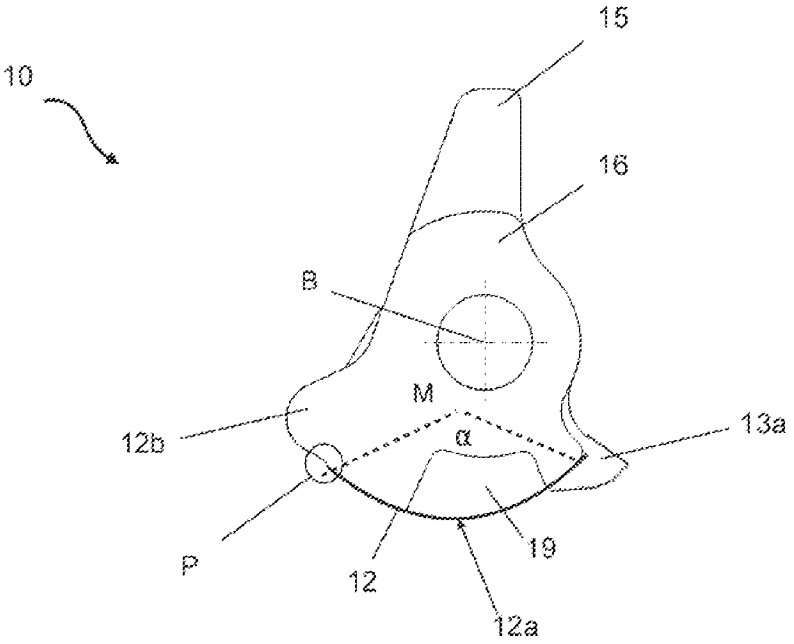
FIG. 1*a* shows the control element from FIG. 1 in another view.

FIG. 1*a* shows a view of the outer end surface of the second arm 16 of the control element. This gives a better view of the eccentric or arched section 12*a*. The eccentric section 12*a* extends circumferentially along a curve over an angle $\alpha$ of approx. 120°. As can be readily seen, the middle M of the curve is outside of the axis of rotation B. The eccentric section 12*a* of the third control section 12 transitions at is left end at the transition P into another radial projection 12*b*, which acts as a lateral stop for a torsion spring.

FIG. 2 shows an example breechblock stop lever 20 in a schematic perspective view (left) and in a schematic lateral section or longitudinal section (right).

Figure 4:
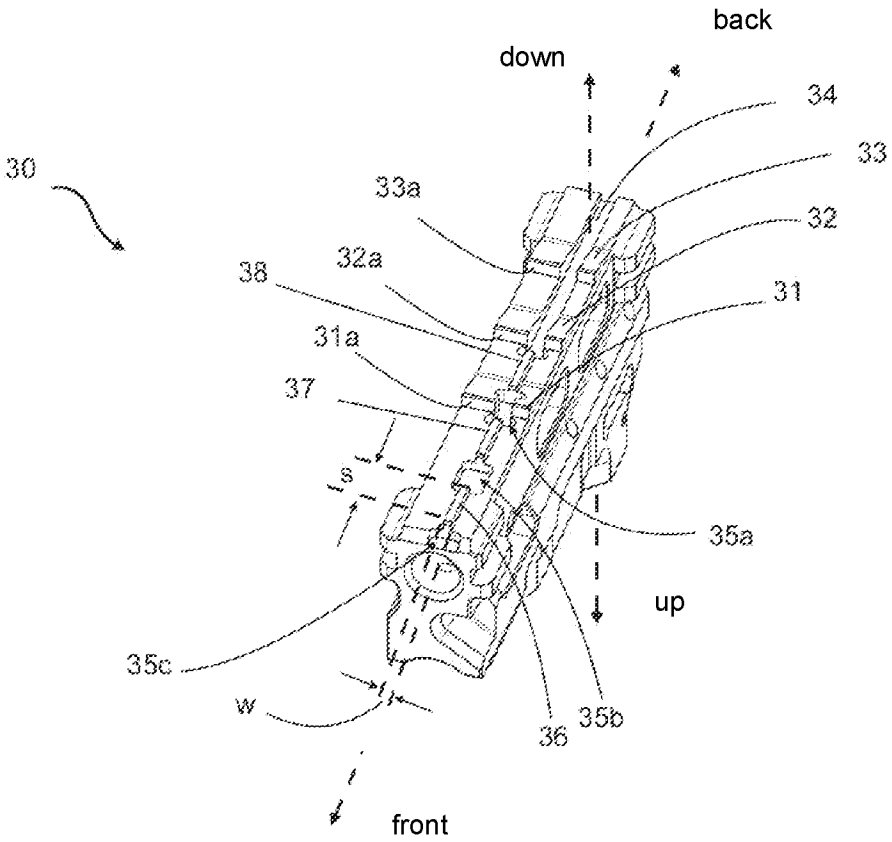
FIG. 4 shows an example breechblock carrier in a schematic view from a perspective.

The breechblock stop lever 20 is shown with the control element 10 from FIG. 1, and is preferably intended for a breechblock carrier 30 described in greater detail in reference to FIG. 4.

The breechblock stop lever 20 has a first axis of rotation A, about which it is rotatably supported. In other words, the breechblock stop lever 20 can rotate in two directions about the first axis of rotation A, specifically in a third direction 93 and in an opposite, fourth direction 94.

The breechblock stop lever 20 also comprises two parallel fastening arms 21, 22, which extend substantially radially to the first axis of rotation A, and receive a control element 10, which has a second axis of rotation B.

Both a first arm 21 and a second arm 22 on the breechblock stop lever 20 have holes 23 on their respective ends. A bolt 81 is inserted through the holes 23 to support the control element 10 on the breechblock stop lever 20.

Aside from the projection 19, the control element 10 is located entirely axially within the fastening arms 21, 22. In other words, the control element 10 is integrated in the breechblock stop lever 20.

The second fastening arm 22 has two stops 24, 25. Both stops 24, 25 comprise a bearing surface, on which the projection 19 on the control element 10 can be brought to bear. The stops 24, 25 are formed by a material removal, wherein the material removal forms a C-shaped curve about the second axis of rotation B. The projection, which is substantially the same thickness as the second fastening arm, moves accordingly along a curved track about the second axis of rotation B, and can rotate freely between the stops 24, 25.

The end of the breechblock stop lever 20 in the region of the stops 24, 25 is also referred to as an end of the fastening arm or breechblock stop lever on the control element side.

If the control element 10 rotates in the first direction 91 to a certain degree, the projection 19 strikes the bearing surface of the stop 24 at its bearing surface 19*a*. If the control element 10 rotates in the other direction 92 to a certain degree, the projection 19 strikes the bearing surface 19*b* on the stop 25.

According to this example, the range of rotation is approximately 160°. This means that the control element 10, and therefore the control section 11 can be rotated or pivoted 160° from one stop 24 to the other stop 25 and back. Other angular ranges are likewise conceivable.

The breechblock stop lever also comprises a stop arm, which is divided into two stop arm sections 26, 27. The stop arm sections 26, 27 extend in substantially opposite directions to the fastening arms 21, 22 from the first axis of rotation A. The stop arm sections 26, 27 snap in place in corresponding catches in the breechblock carrier 30. Each of the stop arm sections 26, 27 have a respective stopping surface 26*a*, 27*a* for this. The stop arm sections 26, 27 are parallel to one another, and connected to one another at their ends by a web 28, which increases the strength of the structure.

The web 28 is placed such that it can pass by the control curve of the breechblock carrier without coming in contact therewith. It can be readily seen that the web 28 is located in a lower region of the ends of the stop arm sections 26, 27. The cross section of the stop arm sections 26, 27 and the web forms an upright U. The distance between the two stop arm sections is greater than the width of the control curve.

In other words, there is space, or a gap 29, between the stop arm sections 26, 27, that extends longitudinally, such that the control curve can extend into, or enter, the space 29 during the return of the breechblock.

The end of the breechblock stop lever 20 in the region of the stopping surfaces 26*a*, 27*a* is also referred to as the end of the stop arm section or the breechblock stop lever at the stop arm side.

The breechblock stop lever 20 also has a hole that is coaxial to the first axis of rotation A, through which a bolt 82 is inserted. The breechblock stop lever is attached to a non-rotating component, such as a handle or receiver, or a part connected thereto, by means of the bolt, such that it can rotate about the first axis of rotation A.

To ensure that the control element 10 does not rotate in an uncontrolled manner about its axis of rotation B, there is a torsion spring 8 wound around the first axis of rotation A, the legs of which at least partially encompass the middle piece 18 of the control element 10 in the annular gap 14 in the control element. To transfer forces effectively, the middle piece has two straight bearing surfaces, against which the legs come to bear. The control element 10 is shown in a middle position in FIG. 2 in which it is retained by the spring 8. Seen in a longitudinal section, the middle piece 18 ends in a triangular profile, wherein the point is at a side of the axis of rotation B facing away from the first axis of rotation A, as can be readily seen in the image on the right in FIG. 2.

It can also be readily seen in the image on the right in FIG. 2 that the breechblock stop lever 20 has a hook or claw 26*b* on a side of the stop arm section 26 facing away from the breechblock carrier 30, which faces toward the first axis of rotation A, for receiving a corresponding claw on a continuous firing element 40.

Figure 3:
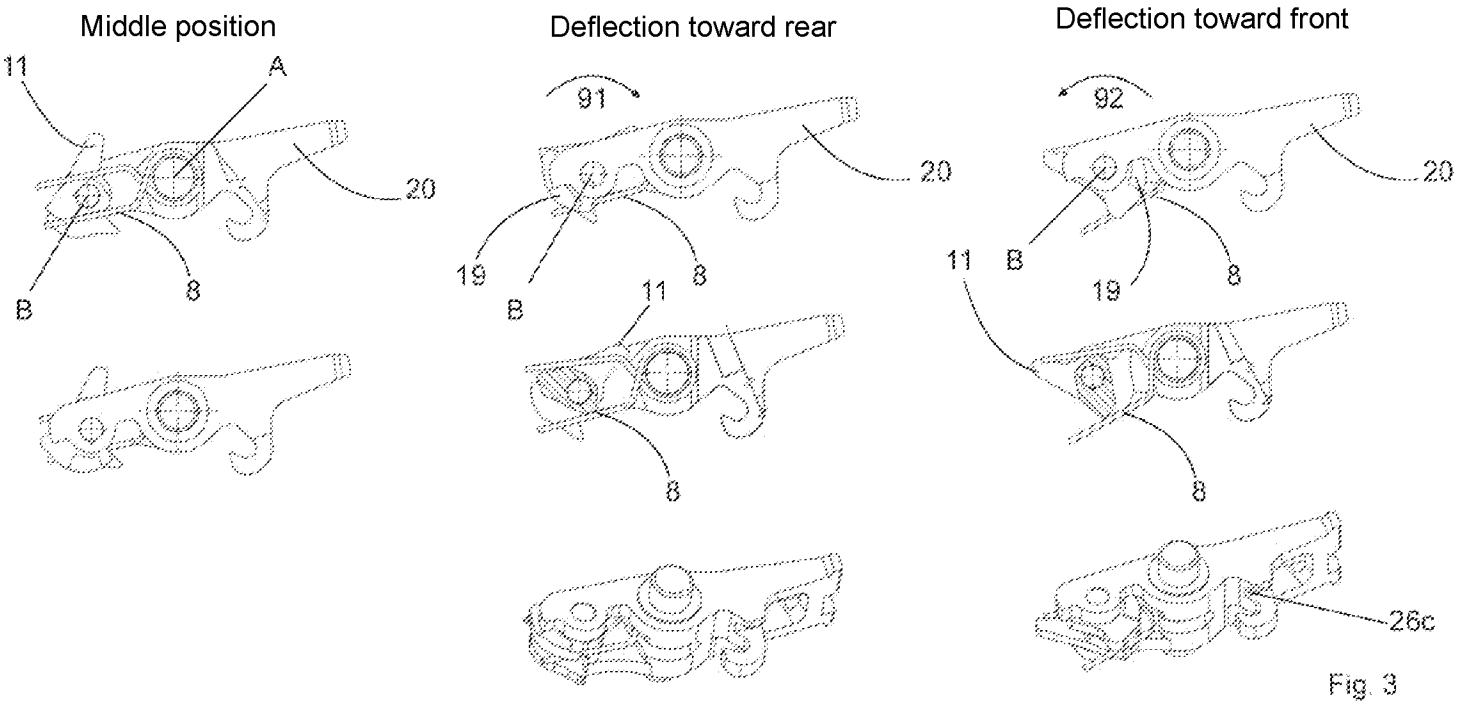
FIG. 3 shows the breechblock stop lever from FIG. 2 and the control element from FIG. 1 in other views, sections, and perspectives.

FIG. 3 shows the control element 10 supported in the breechblock stop lever 20 shown in FIG. 20, in further views, sections, and perspectives.

The control element is in a middle position in the left-hand column. This corresponds to the position shown in FIG. 2 and explained in reference thereto. The left-hand column shows the breechblock stop lever 20 from top to bottom in a schematic side view and in a lateral section. The middle position is also referred to as the vertical position.

In the middle column, the control element 10, or the first control section 11 is as far back as possible, i.e. it is rotated in the direction 91. The projection 19 comes in contact at its stop surface 19*a* in this position with the stop 24 on the breechblock stop lever 20.

The control element 10, or the first control section 11, is at the front in the right-hand column, i.e. it is rotated in the direction 92. In this position, the projection 19 comes in contact at its stop surface 19*b* with the stop 25 on the breechblock stop lever 20. The right-hand column also shows a cross web 26*c*, on which a leg of a torsion spring can bear.

The middle and right-hand columns show the breechblock stop lever from top to bottom in a schematic side view, in a lateral section, and in a perspective.

FIG. 3 also shows the middle piece in a side view, in an example.

As can be readily seen in this side view, the middle piece 18 may have a hexagonal cross section, which partially rounded corners. The substantially parallel sides form the bearing surfaces referred to in reference to FIG. 2. The lower surface is longer than the upper surface. The profile ends at its left side in a triangular profile, as described in reference to FIG. 2, the point of which (front point of the triangle) is at a side of the axis of rotation B facing away from the first axis of rotation A. In other words, the respective left-hand ends of the upper and lower sides of the hexagonal profile are connected to one another via two side lines, which span an angle of approx. 80°-90°. At its right side, the hexagonal profile ends in a triangular profile with rounded corners. In other words, the respective right ends of the upper and lower sides of the hexagonal profile are connected to one another via two side lines spanning an angle of approx. 135°. The rounded corners are also referred to as rear triangle corners.

The side lines that connect the rear triangle point with the right-hand end of the upper side is in part at a clearly smaller distance to the second axis of rotation B than that side that connects the rear triangle point to the right end of the lower side.

The second axis of rotation B, or the second axle, is displaced clearly to the rear, i.e. the distance between the front triangle point and the second axis of rotation B is clearly greater than the distance between the second axis of rotation B and the rear triangle point.

This geometry of the middle piece 18 affects the deflection of the control element 10, or the first control section 11 to both the rear and the front.

The preferred geometry and the rear displacement of the second axis of rotation (B) define the respective points of force introduction, or define the leverages in interaction with the torsion spring 8, and result in having to overcome less spring force when deflected to the rear than when deflected toward the front. In other words, the return force of the spring when in the forward position is greater than when in the rear position. This is advantageous because the control element 10, or the first control section 11, can be quickly rotated back to its middle position after the firing of a shot and the associated acceleration of the breechblock toward the front. This enables a reliable control of the first control section 11 by the breechblock carrier 30, in particular at the start of the return of the breechblock.

It can thus be readily seen in the three sectional illustrations that the torsion spring 8 is rotated in relation to the middle position in both the deflection to the rear and toward the front, wherein the rotation of the torsion spring 8 in the forward deflection is greater than in the deflection to the rear, resulting in the greater force return specified above.

FIG. 4 shows the breechblock carrier 30 in an example shown in a schematic view from a perspective. The perspective is aimed at the lower surface of the breechblock carrier, i.e. toward the side facing the breechblock stop lever.

The breechblock carrier 30 has three catches 31, 32, 33 on its lower surface, each of which has a locking surface 31*a*, 32*a*, and 33*a*, respectively, by means of which the breechblock stop lever 20 can catch the breechblock carrier 30. The catches 31, 32, 33 have a triangular profile, which facilitates the retaining of the breechblock carrier 30. The locking surfaces 31*a*, 32*a*, 33*a* correspond to the contact surfaces 26*a*, 27*a* on the breechblock stop lever 20. The front locking surface 31*a* is the so-called main locking surface.

It can be readily seen that the catches 31, 32, 33 are divided by two longitudinal grooves 34, 35*a* into two catch sections. The rear groove 34 extends from the rear of the breechblock carrier 30 to the rear end of the rear projection 38, and divides the middle catch 32 and the rear catch 33 in to two catch sections in each case, such that a left-hand and right-hand stop arm section are formed in each case. The groove 35*a* divides the front catch 31 into two catch sections, such that a left-hand and right-hand stop arm section are formed here as well.

There is also a groove 35*b* between the front and middle projections 36 and 37. The grooves 35*a* and 35*b* are also referred to as a so-called double-groove.

Another groove 35*c* can also be seen in the projection, which begins at the front end of the front projection 36 and ends shortly thereafter at the front side of the breechblock carrier 30.

The widths of the grooves 34, 35*a*, 35*b* and 35*c* are at least as wide as that of the first arm 15, such that the first arm 15 can extend at least in part into the grooves 34, 35*a, b, c* when controlled accordingly.

The breechblock carrier 30 also has the aforementioned control curve for controlling the control element 10 on its lower surface. The control curve is formed by three projections 36, 37, 38 extending in the radial direction of the longitudinal axis. The projections 36, 37, 38 have a rectangular cross section, wherein the respective length s is greater than the respective width w thereof. The length s to width w ratio is greater than 4:1 in this example. The ratio of the width of the breechblock carrier 30 to the width w of the projections 36, 37, 38 is approx. 8:1. The three projections 36, 37, 38 are also arranged in a straight line.

It can also be readily seen that the respective projections 36, 37, 38 are interrupted axially by the double-groove 35*a*, 35*b*, and end at the rear in the long groove, and at the front in the short groove 35*c*.

The distances between the rear locking surface 33*a* and the rear double-groove 35*a*, the middle locking surface 32*a* and the front double-groove 35*b*, and the front locking surface, i.e. the main stopping surface 31*a* and the short groove 35*c* are the same, and correspond to the maximum distance between the rear edge of the first arm 15, i.e. the first contact surface 11*a* of the control section 11 and the stopping surfaces 26*a*, 27*a* on the breechblock stop lever 20 when the control element is vertical. The projections 36, 37, 38 can slide through the space 29 defined by the stop arms 26, 27 during the return of the breechblock, without touching the rear part of the breechblock stop lever or impeding the movement of the breechblock carrier 30.

The front projection 36 and the middle projection 37 are located in front of the first catch 31, and the rear projection 38 is located between the front catch 31 and the middle catch 32.

The maximum distances between the front ends of the projections 36, 37, 38 (rear ends of the grooves 35*c*, 35*b*, and 35*a*) and the respective locking surfaces 31*a*, 32*a*, 33*a* are functionally the same as or less than the distance between the first arm 15, in particular the first contact surface 11*a*, and the stopping surfaces 26*a*, 27*a* on the breechblock stop lever 20 when the control element is vertical.

As a result, the rear part of the breechblock stop lever 20 can be pushed up by the first torsion spring (cf. FIG. 10, time t2) and the rear part of the breechblock stop lever 20 can lock in place successively in its stopping surface 26*a*, 27*a* when the breechblock carrier 30 is manually slid back, after releasing the third control section 12 from the second element 6 (cf. FIG. 10, time t2) and releasing the second control section 13 from the control surface 55*a* of the trigger 50 (if the trigger is actuated), as soon as the spring-loaded rear part of the breechblock stop lever 20 located in its retained position comes in contact with the catches 33, 32, 31, and passes over them.

To also ensure such a retaining function of the breechblock stop lever 20 when the breechblock is in an intermediate position (e.g. if the forward movement of the breechblock is disrupted), the projections 38, 37, 36 forming the control curve are interrupted by the grooves 35*a*, 35*b*, and 35*c*. The first arm 15 can enter these grooves vertically (relaxed), and then moved to the back again when the breechblock is returned manually. The third control section 12 and the second control section 13 can thus be released from the second element 6, or from the control surface 55*a* on the trigger 50 (when the trigger is actuated), resulting in the rear part of the breechblock stop lever 20 being released again in a spring-loaded manner in its retained position.

Figure 5:
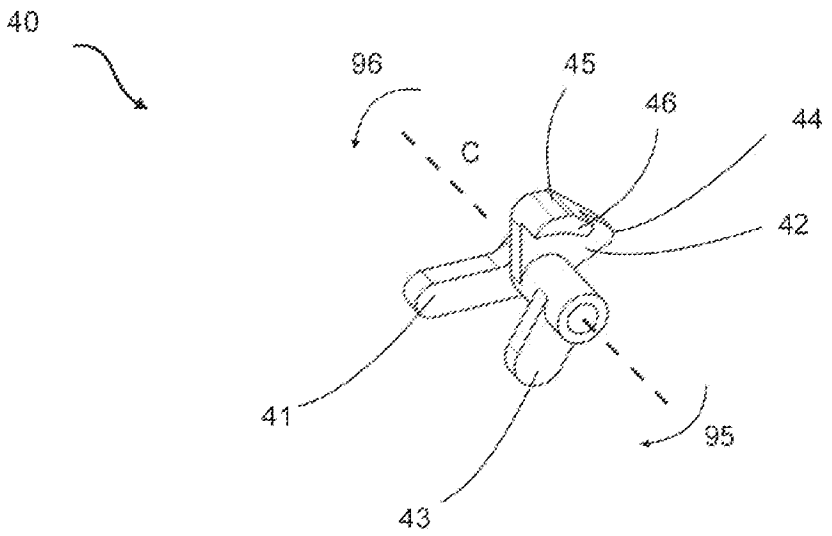
FIG. 5 shows a continuous firing element that can be used in a trigger assembly.

FIG. 5 shows how a continuous firing element 40 can be used in a trigger assembly, in a schematic view from a perspective. The continuous firing element 40 has a third axis of rotation C, and three arms 41, 42, 43 that extend radially in relation to the third axis of rotation C.

A first arm 41 has a substantially rectangular cross section, and ends at its radial end in the shape of a semi-circle. The first arm 41 comes in contact with a control surface on a trigger 50, as described by way of example in reference to FIG. 6.

A second arm 42 has a substantially triangular cross section. The second arm 42, which is located axially between the first arm 41 and the third arm 43, can be retained in place or released by a safety. To prevent the continuous firing element 40 from rotating in the direction 95, i.e. to engage the safety, a safety lever can be mechanically brought in contact with a first corner 44 of the second arm 42. The second arm 42 has a projection 46 at its second corner 45 that extends in the axial direction of the third axis of rotation C, which engages with the hook or claw 26*b* on the breechblock stop lever 20. The projection 46 extends axially toward the third arm 43. The projection 46 can likewise be called a claw.

The third arm 43 has a substantially rectangular cross section and ends at its radial end in the shape of a semi-circle. The third arm 43 is intended in particular to be subjected to the force of a torsion spring to obtain a constant torque to the continuous firing element in the direction 95. Such a torsion spring is indicated by the reference symbol 4 in FIG. 7. The direction counter to the spring force is indicated by the arrow 96.

FIG. 6 shows a trigger 60 that can be used in a trigger assembly in a schematic view from a perspective.

Figure 7:
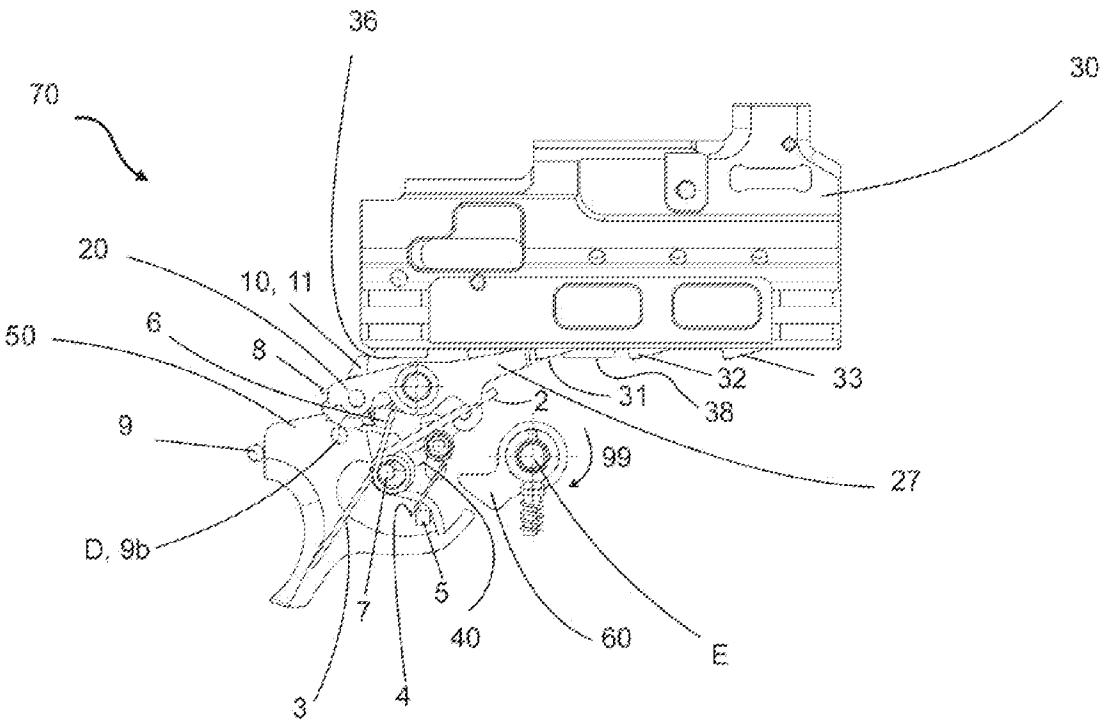
FIG. 7 shows an example trigger assembly.

The trigger 50 has a main body 51 that can pivot about a fourth axis of rotation D, with a thickness y and a shape known per se. The trigger 50 has an actuating element 57 that has a bearing surface 52 on its rear surface for a leg of a torsion spring. Such a torsion spring is shown in FIG. 7 and indicated by the reference symbol 3. The torsion spring pushes the trigger 50 forward in the known manner, i.e. in the direction 97. A curvature of the trigger toward the rear results in a rotation about the fourth axis of rotation D in the direction 98. The actuating element 57 can be brought to bear at the front surface on an element in the handle housing in order to limit the rotation of the trigger when it is actuated. Such an element is shown by way of example in FIG. 8, and indicated there as the fifth element 9*a*.

The trigger also has a first section 53, which can be kept in place by means of a safety lever in order to prevent movement of the actuating element 57. The first section forms an elongated and curved lever, or arm, which tapers toward the end 53*a*. The tapered end 53*a* is particularly suitable for preventing a collision with the stop, or projection 61.

The tapered end 53*a* can also be designed such that it can be retained by a projection 61 in the shape of a claw on the safety lever. Such a safety lever is shown in FIG. 7 and indicated there with the reference symbol 60.

The trigger 50 also has a second section 54 which is used in turn for the direct control of the control element 10 and thus the indirect control of the breechblock stop lever 20. Furthermore, the rotation of the continuous firing element 40 can be blocked and allowed by means of the second section 54.

The first section 53 and second section 54 are formed by a material removal in the main body 51 and likewise exhibit a thickness y.

The second section 54 comprises a projection 55 that extends axially, with a greater thickness z than the main body 51, for controlling the control element 10. The projection 55 also has a control surface 55*a* and a control edge 55*b* on its upper surface, i.e. the side facing toward the control element 10. The control surface 55*a* is intended for guiding, or controlling, the control section 13 and in particular the projection 13*a* on the control element.

There is a hole 56 that is coaxial to the fourth axis of rotation D, through which a pin, rod, or bolt cab be inserted in order to rotatably support the trigger 50 on a non-rotating component, e.g. a housing on a handle. This pin, rod, or bolt is preferably fastened to a wall of the handle on the left and right sides of the weapon, such that the trigger is held securely in place, and can thus be better guided.

FIG. 7 shows an example trigger assembly 70 for an automatic weapon, not shown in greater detail, such as a machine gun, in a schematic view of a cross section thereof.

According to this example, the trigger assembly 70 comprises the control element 10 shown in FIG. 1, the breechblock stop lever 20 shown in FIG. 2, the continuous firing element 40 shown in FIG. 5, and the trigger 50 shown in FIG. 6, such that reference can be made to the explanations above, in reference thereto. The trigger assembly 70 also comprises a safety in the form of a safety lever 60. There are also torsion springs 2, 3, 4, 8, and four elements, or stops 5, 6, 7, 9 secured to the housing. In addition to the trigger assembly 70, the breechblock carrier 30 shown in FIG. 4 is also shown, which is engaged with the trigger assembly 70.

The trigger 50 can be moved in the known manner between a non-actuated position and an actuated position. The stop arm sections 26, 27 of the breechblock stop lever 20 are locked in place in a front catch 31, which is the main catch, on the breechblock carrier 30, such that the breechblock carrier 30 is held in place by the breechblock stop lever 20. The control element 10 is supported on the breechblock stop lever 20 such that it can rotate about the second axis of rotation B, and can be controlled from below by the trigger 50 and from above by the breechblock stop lever 20. Because the control element 10 is rotatably supported on the breechblock stop lever 20, the control element 10 can also rotate about the first axis of rotation A for the breechblock stop lever, when the breechblock stop lever 20 moves.

Such a control element 10 holds the breechblock stop lever 20 down when the breechblock moves forward, and releases the breechblock stop lever 20 when the breechblock returns by interacting with the control surface 55*a* on the trigger 50 and the element 6 on the handle housing.

In the continuous firing mode, the breechblock stop lever 20 is held down by the continuous firing element 40 while shots are fired.

Regarding the further construction of the trigger assembly 70:

A first leg of a first torsion spring 2 braces against a first element 5, and presses with a second leg against the breechblock stop lever 20. The second leg of the first torsion spring 2 bears on a bearing surface on the breechblock stop lever 20, formed in this example by a cross web 26*c* on the hook 26*b* at the start of the first and second stop arm sections 26*a*, 27*a* (cf. FIG. 3, lower right). The so-called "torsion spring for the breechblock stop lever" causes a torque in the direction 94. In other words, the breechblock stop lever 20 is pushed upward by the torsion spring 2 into the retaining position. The first torsion spring 2 is wound around a third element 7.

A first leg of a second torsion spring 3 braces against a second element 6 and presses with a second leg against the trigger 50. The second leg bears on the bearing surface 52 of the trigger 50 (cf. FIG. 6). The so-called "torsion spring for the trigger" causes a torque in the direction 97. In other words, the spring force of the second torsion spring 3 counteracts a movement of the trigger 50. To retain the trigger in the non-actuated position, i.e. to generate a torque acting against the spring force of the torsion spring 3, there is an element 9 fixed in place on the housing, which is located at an upper end of the actuating element 57, against which the trigger 50 is braced. The second torsion spring 3 is likewise wound around the third element 7.

A first leg of a third torsion spring 4 braces against the element 5, and presses with a second leg against the continuous firing element 40. The second leg bears on a bearing surface formed by the third arm 43 on the continuous firing element 40, in particular such that it second leg encompasses the third arm in the axial direction. The so-called "torsion spring for the continuous firing element" is wound around the third axis of rotation C, in particular about a sleeve-like part of the continuous firing element 50, and causes a torque in the direction 95.

The force of the first torsion spring 2 (torsion spring for the breechblock stop lever) is greater than the force of the second torsion spring 3 (torsion spring for the trigger), and the force of the second torsion spring 3 is greater than the force of the third torsion spring 4 (torsion spring for the continuous firing element).

A fourth torsion spring 8 is wound around the first axis of rotation, and holds the control element 10 in a middle position. The control element 10 can pivot in both directions 91, 92 about the second axis of rotation B, counter to the force of the fourth torsion spring 8.

Figure 8:
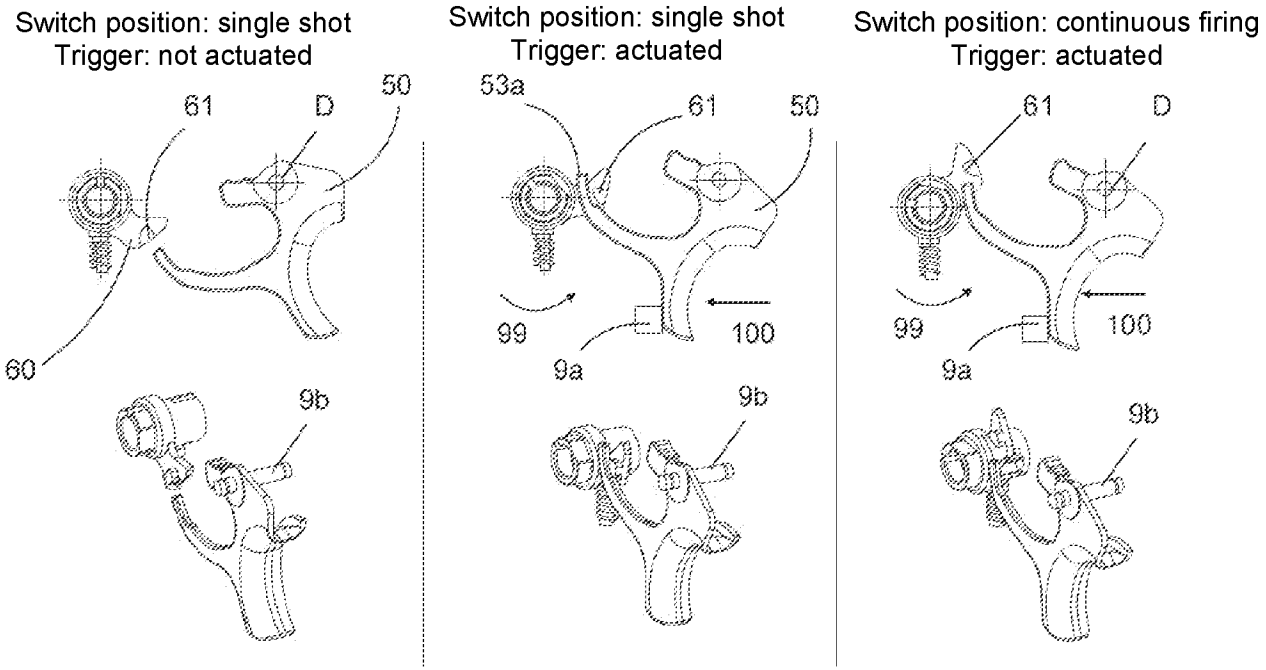
FIG. 8 shows the trigger in FIG. 6 and FIG. 7, interacting with a safety, in further views, sections, and perspectives.

The trigger 50 comes in contact with the second control section 13, or the radial projection 13*a* on the control element 10 after it has been actuated with its control surface 55*a* formed on the projection 55. The projection 55 prevents the continuous firing element 40 from rotating about its own axis of rotation C when the trigger is not pulled. If the trigger 50 is actuated, the bearing surface 52 on the actuating element 57 bears on a fifth element 9*a* fixed in place on the housing, which is shown in FIG. 8, in order to limit the movement of the trigger 50 toward the rear.

The control curve on the breechblock carrier 30 can deflect the first control section 11 counter to the force of the fourth torsion spring 8 in the direction 92 when it slides forward, and counter to the force of the fourth torsion spring 8 in the direction 91 when it slides back.

A safety lever 60 that can pivot about its axis E, which is combined with the firing selection lever, holds the trigger 50 in place. The safety lever 60 can also assume the settings, "single shot," and "fully automatic firing." In the "single shot" setting, the safety lever 60 allows the trigger 50 to move, and also holds the second arm 42 of the continuous firing element 40 in place. In the "fully automatic firing" setting, the safety lever 60 releases the trigger 50 as well as the continuous firing element 40. The state of the weapon, as shown in FIG. 7, is loaded and secured.

Starting from the first setting (secured) shown in FIG. 7, the safety lever 60 can be rotated in the direction 99 to a second setting (single shot). From this setting, it can be rotated in the direction 99 to its third setting (continuous firing). Counter to the direction 99, the safety lever can be rotated back from the third setting to the second setting, and from there to the first setting.

FIG. 8 shows the trigger 50 shown in FIG. 6, interacting with a safety 60 in the form of a safety lever, in other views, sections, and perspectives. The trigger is shown from the left in FIG. 6, but in FIG. 8, the trigger 50 and the safety lever 60 are shown from the right.

The safety lever 60 can assume three settings: a first setting or position is shown in the left-hand column in FIG. 8. In this setting, the safety lever 60 is behind the first section 53 of the trigger 50, and mechanically prevents it from being fully actuated. The safety lever 60 is then in the "safety on" setting.

A second setting is shown in the middle column in FIG. 8. The safety lever 60 is in the setting for "single shot." The safety lever 60 releases the trigger 50, and simultaneously holds the continuous firing element 40 (not shown) in its position. It can be readily seen how the stop 61 on the safety lever 60 releases the tapered arm 53*a* of the trigger 50. The trigger 50 is fully actuated in the direction 100, and bears with the rear surface of the actuating element 57 on an element 9*a* fixed in place on the housing. The element 9*a* prevents the trigger 50 from further movement to the rear, in the direction 100.

A third setting is shown in the right-hand column in FIG. 8. The safety lever 60 is in the setting, "continuous firing." The safety lever 60 releases the trigger 50, as well as the continuous firing element 40 (not shown). The trigger 50 is fully actuated in the direction 100, and the rear surface of the actuating element 57 bears on the element 9*a* fixed in place on the housing.

A sixth element 9*b* in the form of a pin can be seen in all three illustration, about which the trigger 50 can be pivoted about its axis of rotation D. The element 9*b* can also be referred to as an axle.

Figure 9:
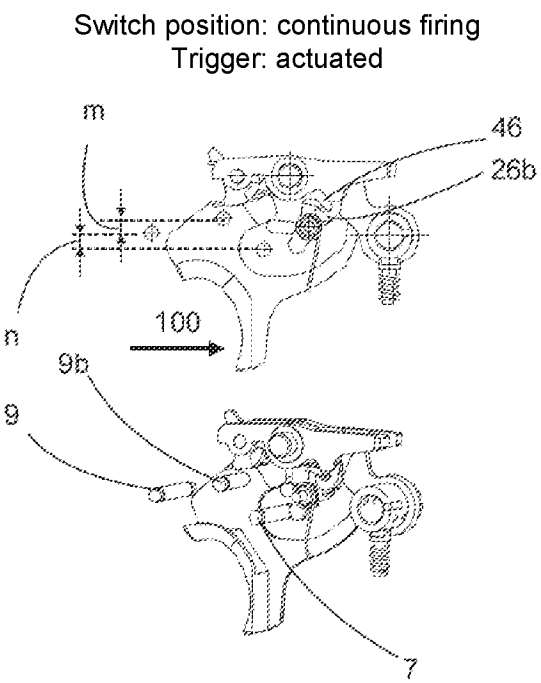
FIG. 9 shows parts of the trigger assembly from FIG. 7 in other views (in the fully automatic firing setting)
Figure 9:
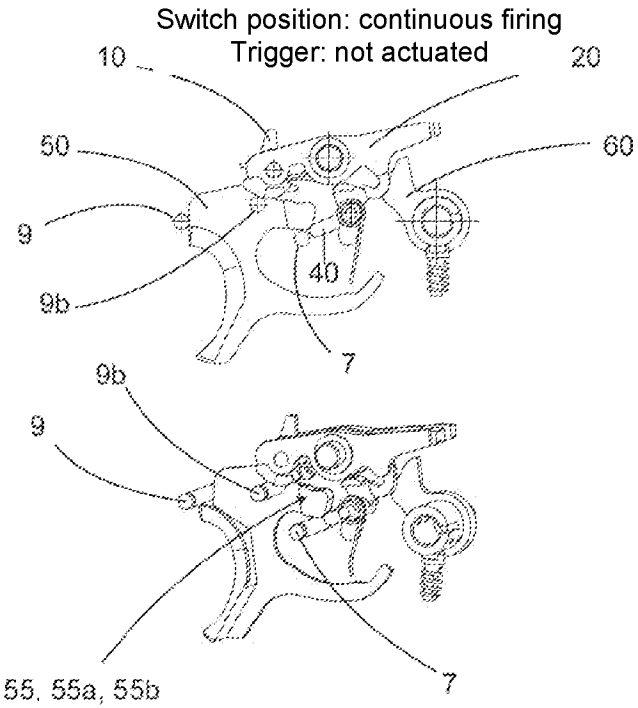

FIG. 9 shows parts of the trigger assembly 70 shown in FIG. 7, specifically the control element 10, the breechblock stop lever 20, the continuous firing element 40, the trigger 50, and the safety lever 60, in a schematic view (from the left) and in a perspective.

The safety lever, or firing selection lever 60, is in the setting "fully automatic firing" in both columns. The trigger 50 is in a non-actuated setting in the left-hand column, and holds the continuous firing element 40 in place. As can be readily seen, the control element 10 is in its middle position. The trigger 50 is released, and braced on the element 9.

The right-hand column shows the trigger 50 in an actuated position. The continuous firing element 40 rotates in the clockwise direction (direction 95) about its own axis of rotation C, due to the spring force of the torsion spring 4. The claw 46 on the continuous firing element 40 and the hook 26*b* on the breechblock stop lever 20 then engage in one another. The breechblock stop lever 20 is held "down" until the trigger 50 is released. After releasing the trigger 50, it then brings the continuous firing element 40 back into the starting position.

While the trigger 50 is actuated, the control element 10 is moved back and forth by the breechblock carrier 30. In the snapshot on the right in FIG. 9, the control element 10 has been moved forward, i.e. rotated in the direction 92.

It can also be readily seen in the right-hand column that the axes of the three elements 7, 9, and 9*b* are spaced apart vertically. There is therefore a distance n between the axis of the element 7 and the axis of the element 9, and a distance m between the axis of the element 9 and the axis of the element 9*b*.

Figure 16A:
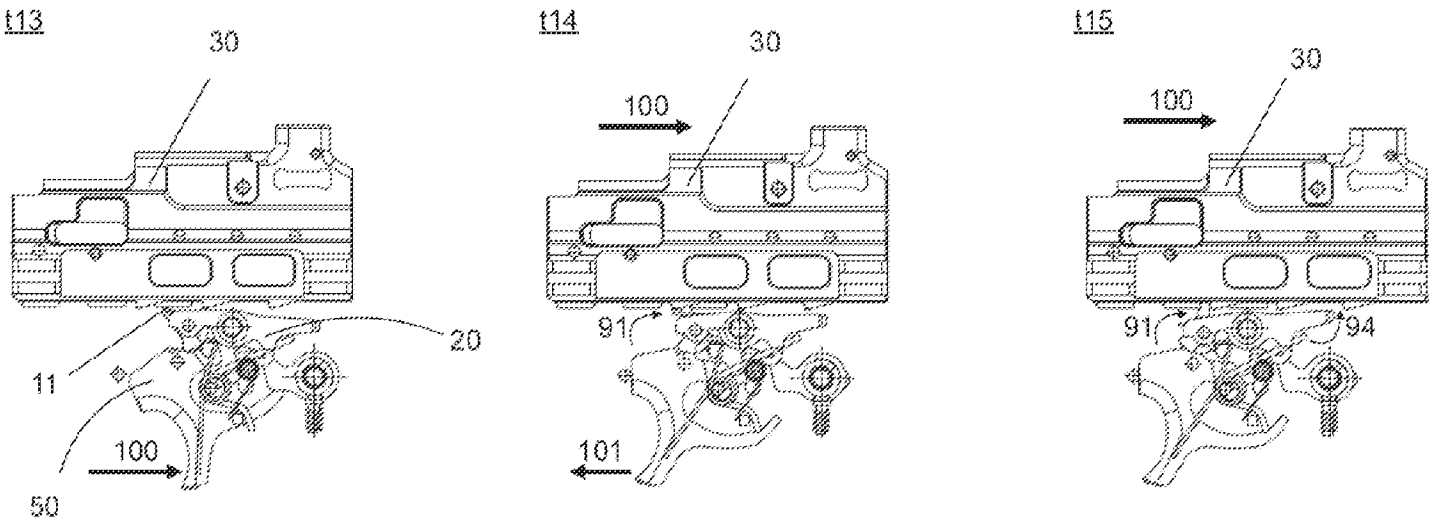
FIGS. 16*a, b* show a temporal sequence of the removal of a disruption in the forward movement of the breechblock in the single shot setting.
Figure 16B:
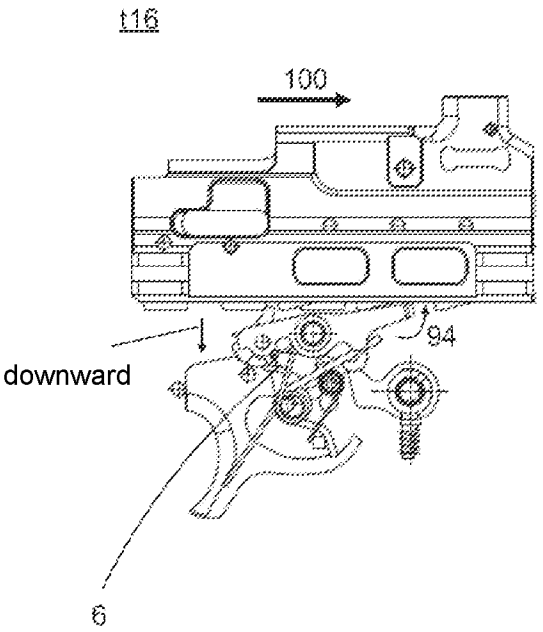
Figure 16B:
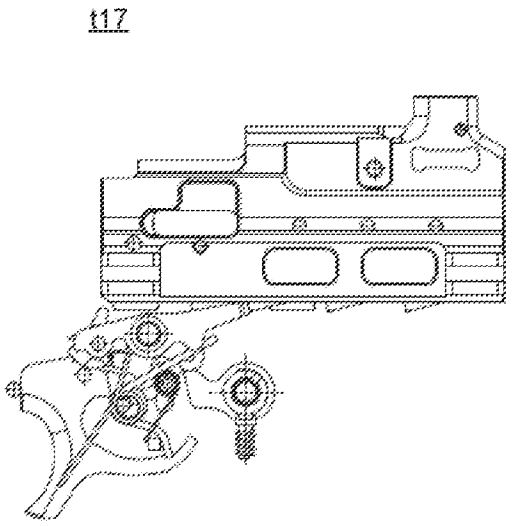
Figure 17A:
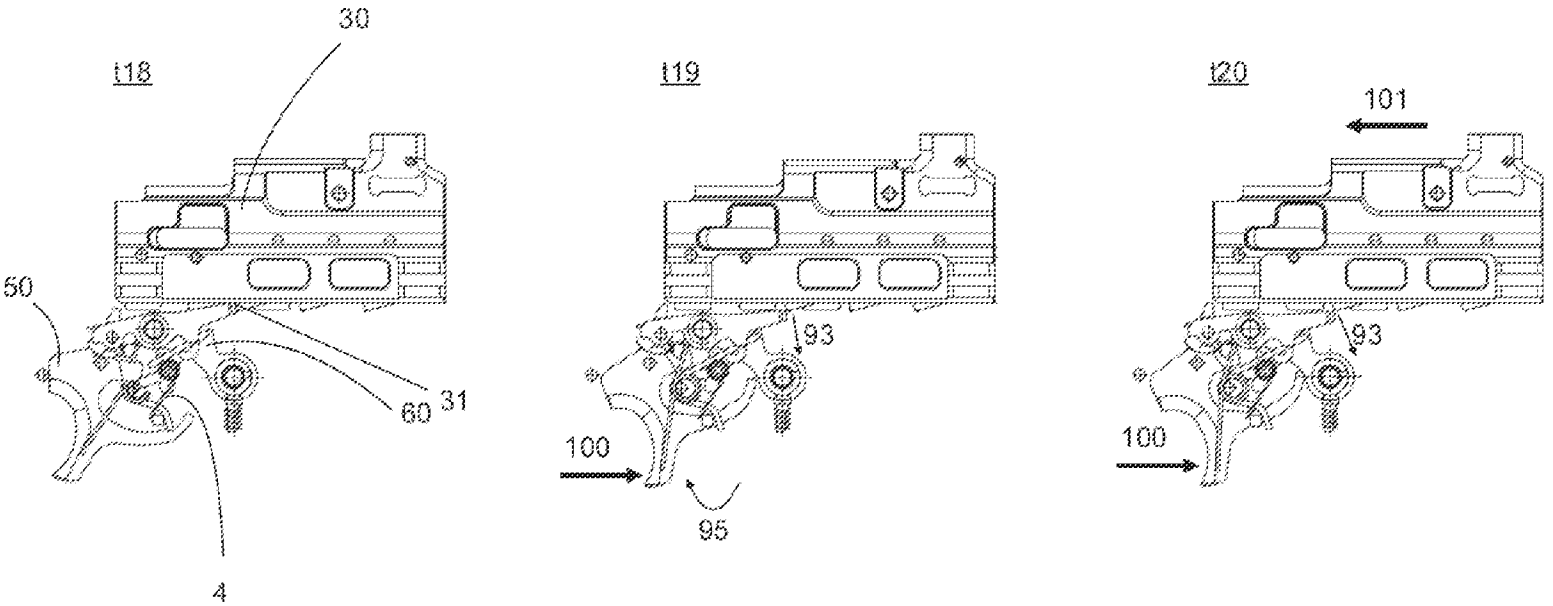
FIGS. 17*a-c* show a temporal sequence of numerous firings in the fully automatic firing mode.
Figure 17B:
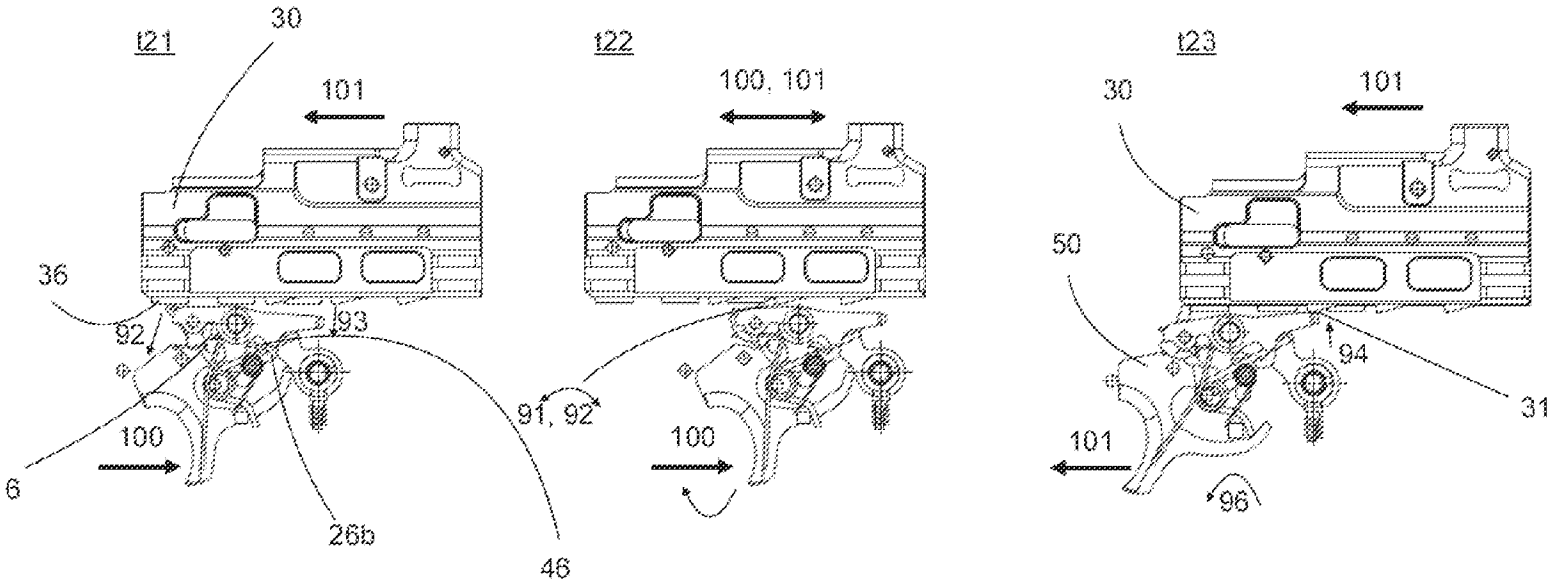
Figure 17C:
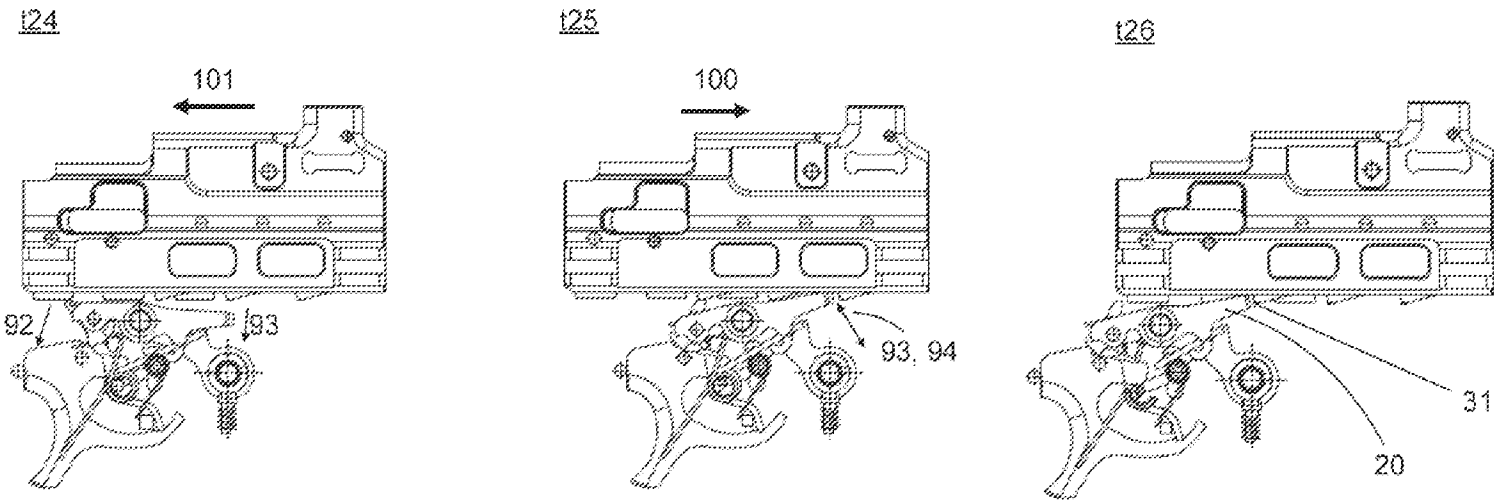

The dynamic interaction of the individual assemblies shall be described in greater detail below in reference to FIGS. 10 to 17*c*, in particular in reference to the functions, "loading in the secured state," (FIGS. 10*a*, 10*b*), "single shot" (FIGS. 11*a* to 11*d*), "disruption in forward movement of the breechblock" (FIGS. 16*a*, 16*b*), and "fully automatic firing" (FIGS. 17*a* to 17*c*).

Figure 10A:
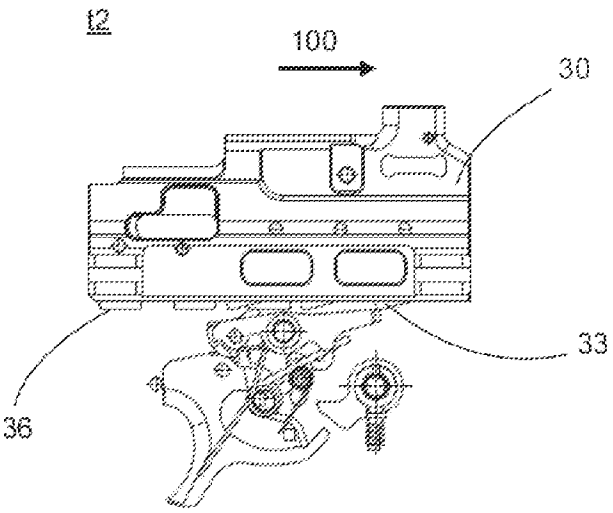
FIGS. 10*a, b* show a loading sequence for the weapon, or the trigger assembly from FIG. 7 (loading in the secured state)
Figure 10A:
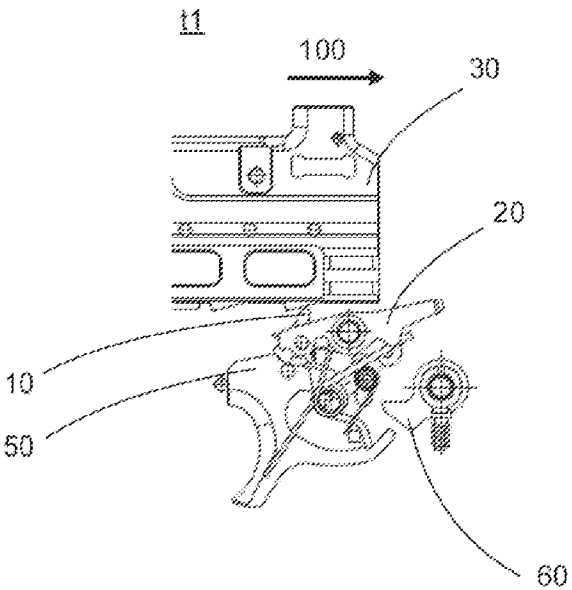
Figure 10B:
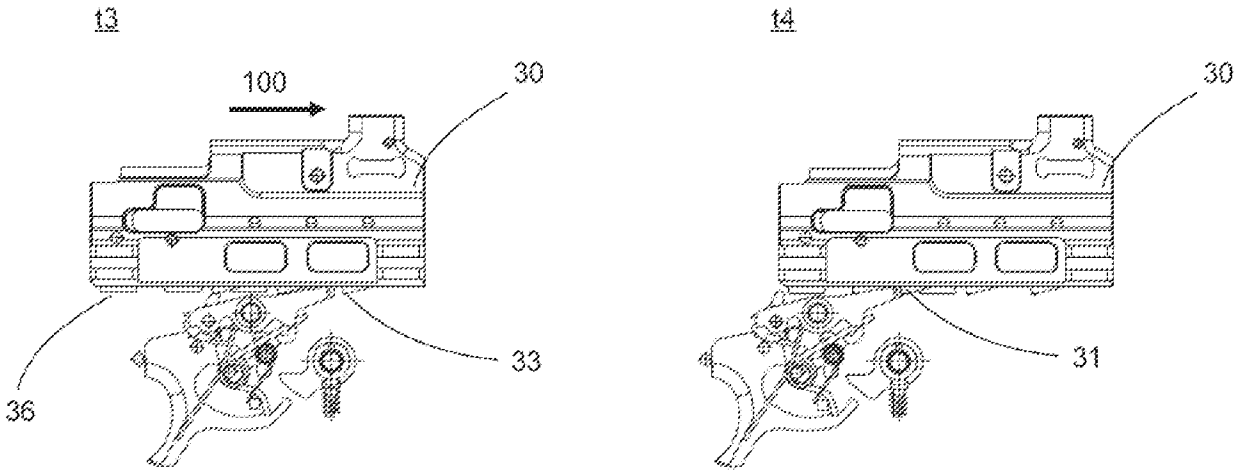
Figure 11A:
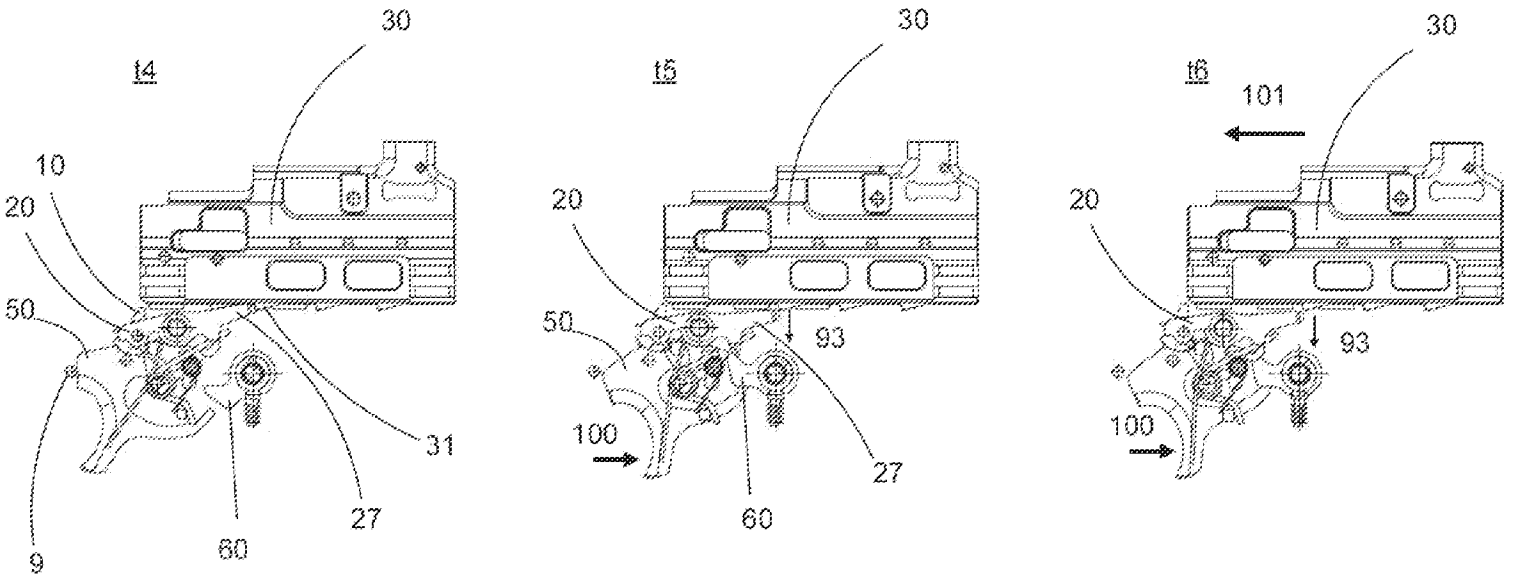
FIGS. 11*a-d* show a temporal sequence for firing a shot in the single shot mode.
Figure 11B:
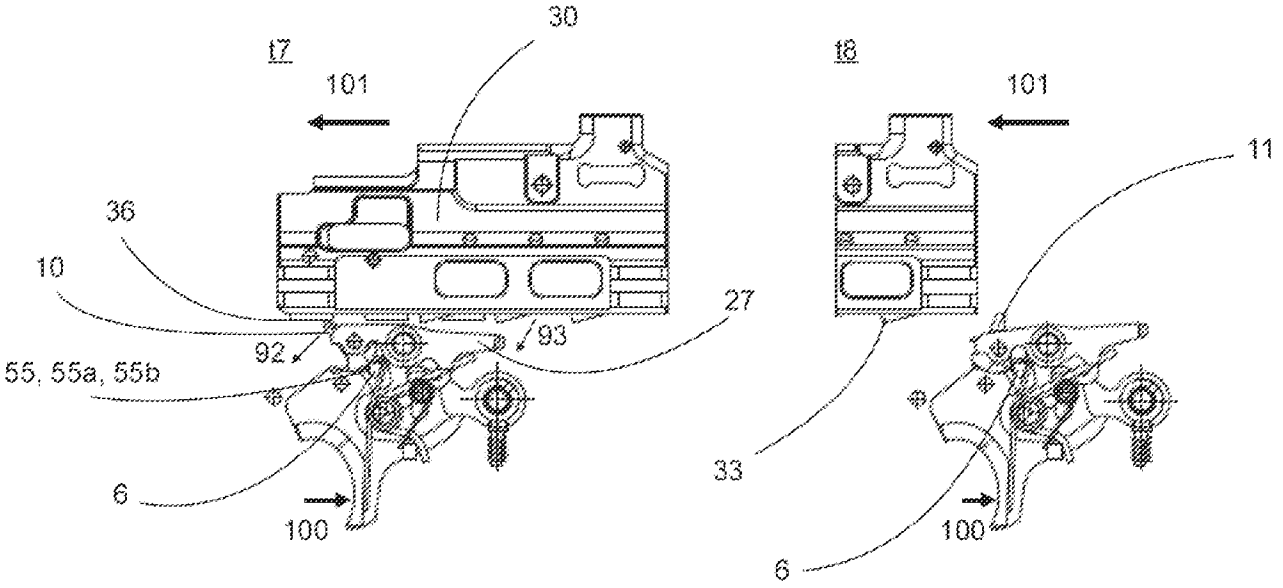
Figure 11C:
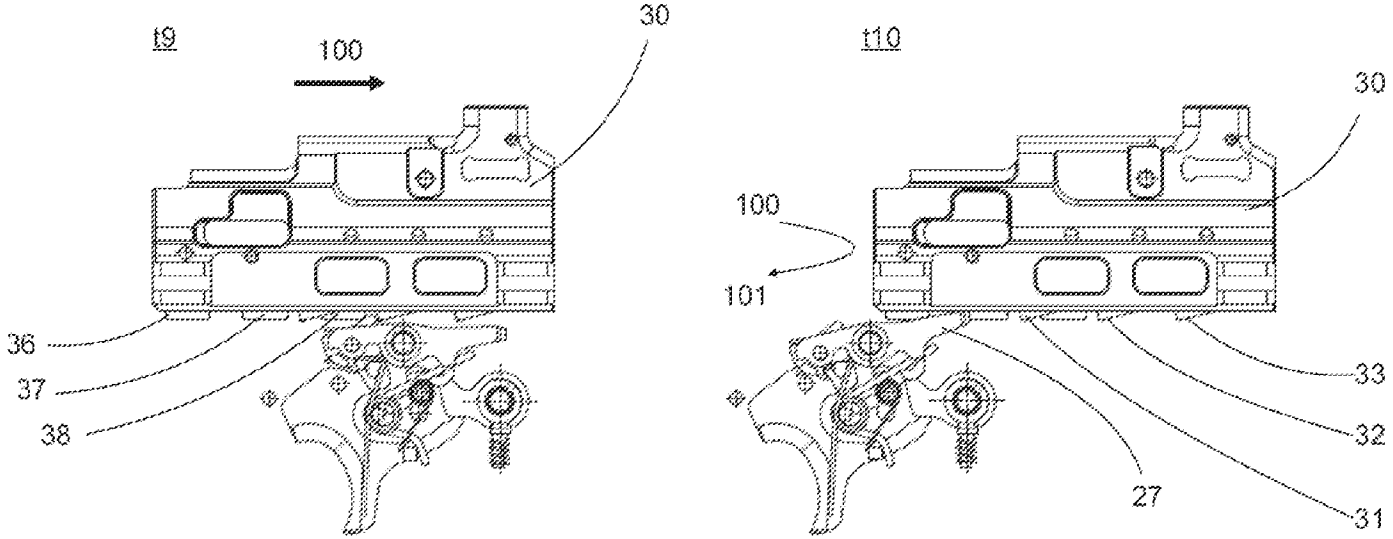
Figure 11D:
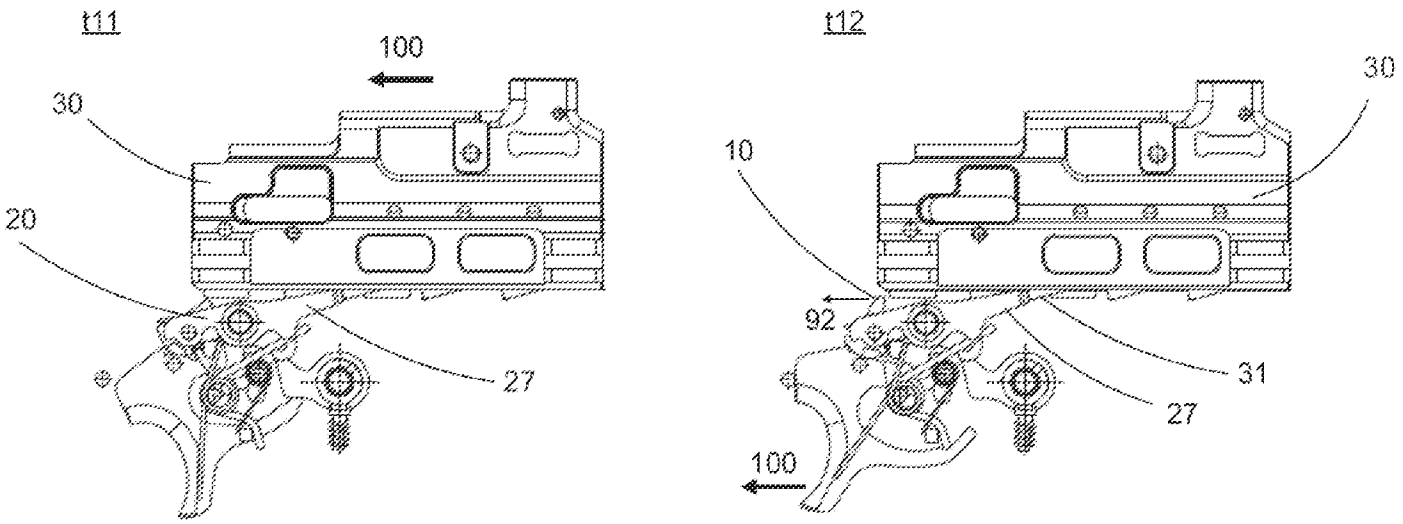

FIGS. 10*a*, 10*b* show the loading sequence for the weapon, or the trigger assembly 70 shown in FIG. 7, in the secured state, in reference to four successive points in time t1, t2, t3, and t4.

Time t1: The safety lever 60 is in its first position, i.e. securing the trigger 50, such that the safety is on. The control element 10 is in its middle position, and is not in contact with the breechblock carrier 30. The third control section 12 is released from the second element 6 fixed in place on the housing. The breechblock stop lever 20 is rotated by the first torsion spring 2 in the counterclockwise direction 94, until the second control section 13 and the third control section 12 on the control element 10 are on the upper surface of the fourth axis of rotation D. The stopping surfaces 26*a* and 27*a* on the breechblock stop lever 20 are then in the "catch position." The breechblock, or the breechblock carrier 30, is moved backward by hand, in the direction 100.

Time t2: While the breechblock carrier 30 is moved back, the catch 33 comes in contact with the stop arm sections 26, 27 on the breechblock stop lever 20, and pushes the breechblock stop lever 20 down, i.e. counter to the force of the torsion spring 2, in the direction 93.

By pushing the back end of the breechblock stop lever 20 down with the catch 33, the front end of the breechblock stop lever 20 is lifted briefly by the control element 10, i.e. temporarily. During the temporary lifting by the control element 10 as a result of the catches 33, 32, 31, the control curves 38, 37, 36 successively pass over the control element 10, pushing it backward each time, which has no effect in the present case on the breechblock stop lever 20, however, because the control element 10 does not bear with either its second control section 13 on the control surface 55*a* on the trigger 50, on with its control section 12 on the second element 6, i.e. the control section 11 repeatedly rotates about its own axis of rotation B, in the direction 91.

Time t3: While the breechblock carrier 30 continues to move backward, the breechblock stop lever 20 catches in the rear catch 33. If the breechblock is moved further back, the breechblock stop lever 20 catches in the same manner in the middle catch 32, and then in the front catch 31.

As soon as the projection 38 no longer passes over the control element 10, and it is in the rear groove 35*a* with its first control section 11, it is moved back in the second direction 92 to its starting position by the fourth torsion spring 8.

This pivotal movement (i.e. deflection of the control element and pushing back of the control element to the middle position by the spring) of the first control section 11 on the control element 10 is repeated during the manual return of the breechblock when passing over the control section 11 by the middle projection 37, the front groove 35*b*, the front projection 36, and the groove 35*c* on the front side of the breechblock carrier 30.

Time t4: The breechblock carrier 30 is now locked in place in its front catch 31. The breechblock stop lever 20 holds the breechblock carrier 30 in this position. The control element 10 is in its middle position. The weapon is loaded and secured.

FIGS. 11*a*, 11*b*, 11*c*, and 11*d* show the sing shot sequence of the weapon, or the trigger assembly 70 shown in FIG. 7, based on nine successive points in time t4, t5, t6, t7, t8, t9, t10, t11, and t12.

Time t4: The weapon is loaded and secured.

Time t5: The safety lever 60 is in its second setting, the single shot position, which releases the trigger 50, and holds the continuous firing element 40 in position. The trigger 50 is actuated in the direction 100, and pushes the control element 10 upward, in the direction of the arrow, such that the stop arm sections 26, 27 of the breechblock stop lever 20 rotate in the direction 93, and are moved down, in the direction of the arrow.

Time t6: The trigger 50 is actuated entirely. The breechblock stop lever 20 is moved out of its retained position and into its standby position, in which the breechblock carrier 30 is then released. The breechblock carrier 30 accelerates forward as a result of the force of the closing spring, in the direction 101.

Time t7: The control section 11 is moved by the front projection 36 toward the front (movement 92). The control element 10 slides over the control surface 55*a* on the trigger 50 while it is pressed with its projection 13*a* and its second control section 13, and moves with its eccentric third control section 12 up to its projection 12*b* and over the element 6 fixed in place on the housing.

The projection 19 on the control element 10 bears with its stop surface 19*b* on the stop 25 on the breechblock stop lever 20.

Because of the eccentric design of the control section 12 up to its projection 12*b*, the leverage effect is increased, and the stopping surfaces 26*a* and 27*a* of the breechblock stop lever 20 are pressed down further, disengaging from the stopping surfaces 31*a*, 332*a*, 33*a* on the breechblock carrier 30 in the third direction 93, toward the standby position.

Time t8: The breechblock carrier 30 is in its frontmost position. The control lever 10 is pushed into its middle position by the torsion spring 8 in the breechblock stop lever 20. The control lever 10 braces at this point against the element 6 as well as the control surface 55*a* on the actuated trigger 50. There is therefore a spacing between the axis D and the control sections 12, 13.

After the breechblock has moved forward as far as possible, and a cartridge has been loaded and fired, the breechblock carrier 30 is returned by the gas pressure from the fired cartridge, as shown in reference to the following point in time t9.

Time t9: A cartridge is fired and the breechblock, or breechblock carrier 30, returns, due to the gas pressure from the fired cartridge, in the direction 100. The contact surface 1 lb on the first control section 11 is moved back by the rear projection 38 (rotation 91). The second control section 13, in particular the projection 13*a* on the control element 10 slides over the control edge 55*b* on the trigger 50, and "falls" down. The breechblock stop lever 20 is rotated upward, toward its retained position.

Time t10: The breechblock carrier 30 moves in direction 100 toward a rear end stop, and is pushed forward again, in direction 101, by the closing spring force. The breechblock stop lever 20 is then in its retained position.

The breechblock turns over in its rearmost position, and is retained in the single shot setting of the firing selection lever 60, as shown below in time t11, by the breechblock stop lever 20 in its front catch 31. If the trigger 50 is released and the firing selection lever 60 set to "safety on," a new belt can be placed in an empty cartridge feed, such that the weapon is again ready to be fired.

If the breechblock is returned while the trigger 50 is pressed, the projections 36, 37, 38 move the first arm 15 of the control lever back, at which point the second control section 13 of the control lever is moved with its projection 13*a* over the control surface 55*a* and the control edge 55*b* of the pressed trigger 50, and the control lever 10 tips down with the front surface of the breechblock stop lever 20 and the rear part of the breechblock stop lever 20 tips up, at which point the breechblock carrier 30 passing over the breechblock stop lever 20 is retained in its front main catch 31 as the breechblock stop lever 20 moves forward again, and can first be released again when the trigger 50 is again actuated.

Time t11: The breechblock stop lever 20 locks in place in the front catch 31 on the breechblock carrier 30, and holds the breechblock carrier 30 in this position.

Time t12: The trigger 50 is released. The torsion spring 8 pushes the control element 10 back into its starting position, specifically its middle position. The weapon is now loaded and not locked. The single shot firing can then be repeated.

Figure 12:
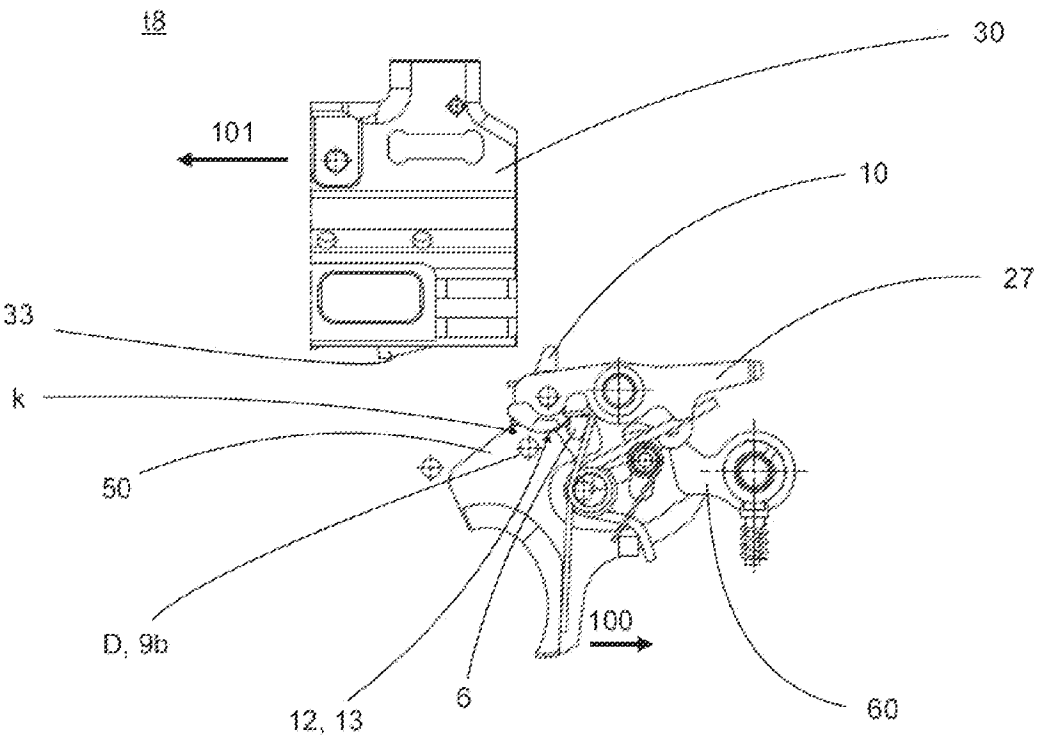
FIG. 12 shows an enlargement of a snapshot from FIG. 11*a;*

FIG. 12 shows the weapon at time t8, in an enlargement. This view shows, in particular, the distance between the axis D and the control section 12 or 13. The distance is indicated by the letter k. The control lever 10 is braced at this point on both the element 6 (not visible in FIG. 12) and the control surface 55*a* on the actuated trigger 50.

Figure 13:
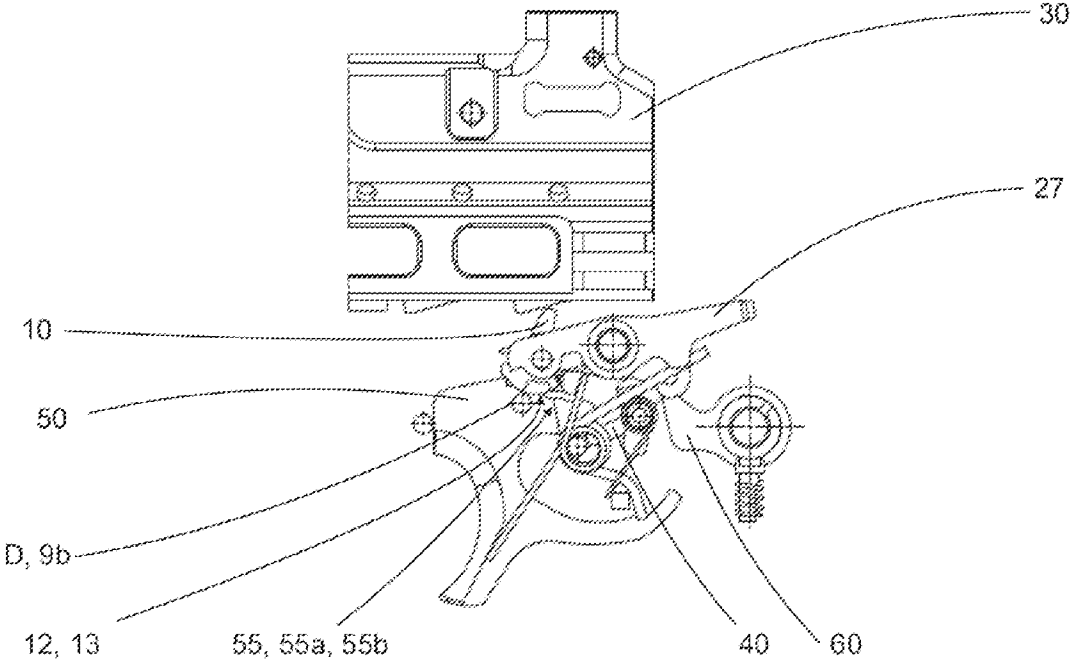
FIG. 13 shows another enlargement of a snapshot in the single shot setting and when the trigger is not actuated.
Figure 14:
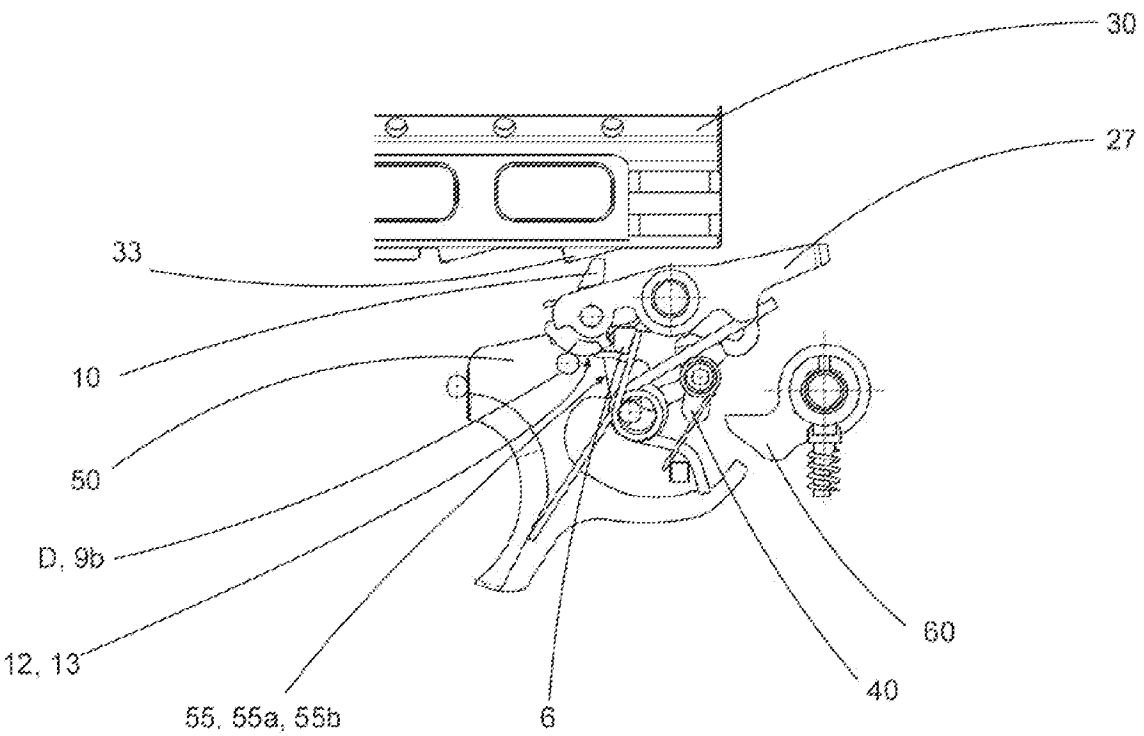
FIG. 14 shows another snapshot in the secured setting.

FIGS. 13 and 14 show the breechblock stop lever 20 in a front position of the breechblock, with a released, i.e. not actuated, trigger 50. The firing selection lever 60 is in the setting "single shot" in FIG. 13, and it is secured in FIG. 14. The control lever 10 braces against the axis D, or 9*b* for the trigger 50 with its second and/or third control section 13, 12 in both FIG. 13 and FIG. 14. The breechblock is then returned manually and subsequently released.

Figure 15:
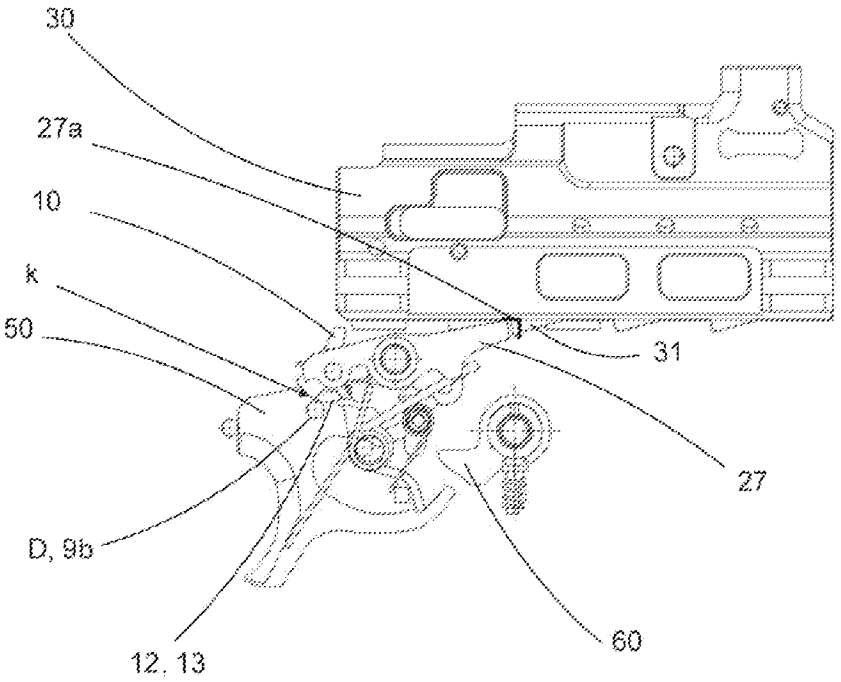
FIG. 15 shows a snapshot in a secured setting in which the breechblock carrier is secured in the main catch.

FIG. 15 shows the breechblock stop lever 20 of the breechblock retained when moving forward, with the trigger 50 released, and the safety lever 60 on.

The control lever 10 does not bear — as it does in FIGS. 13, 14—on the axis D for the trigger 50 with its second and third control sections 13, 12, when the breechblock stop lever 20 is in the locking position, in order that the breechblock stop lever 20 can fully engage with its stopping surfaces 26*a*, 27*a* in the catches 31, 32, 33 on the lower surface of the breechblock carrier 30, until reaching the stop. It can be seen how the stop arm section 27 bears with an upward facing surface of the stop surface 27*a* entirely on the lower surface of the breechblock carrier 30 and with a backward facing surface of the stop surface 27*a*, entirely on the stop, or catch 31.

In other words, the breechblock stop lever 20 braces against the breechblock carrier 30, to ensure that it makes a full-surface contact in the catch 31 on the breechblock carrier 30. The distance between the axis D and the control sections 12, 13 is indicated by the letter k. The distance k in FIG. 15 is less than the distance kin FIG. 12.

FIGS. 16*a* and 16*b* show the sequence of a disruption in the forward movement of the breechblock on the weapon, or trigger assembly 70 shown in FIG. 7, at five successive points in time t13, t14, t15, t16, and t17.

Time t13: The trigger 50 is actuated (direction 100). The breechblock is stopped from moving forward due to a disruption, in particular a loading disruption.

Time t14: The trigger is released due to the disruption (and then moves in direction 101), and the breechblock is returned by hand, i.e. slid back. As the breechblock, or breechblock carrier 30 moves back 100, the control section 11 extends into the intermediate space, or the second groove 35*a*, which separates the front catch 31 into two catch sections, due to the spring force of the fourth torsion spring 8.

The weapon can also be secured during this procedure for correcting a disruption, and all other operations can be carried out in the secured state.

Time t15: The middle projection 37 on the control curve controls the second contact surface 11*b* on the first control section 11, and rotates it in the clockwise direction (direction 91). By rotating the control section 11 in direction 91, the third control section 12 on the control element 10, which has so far been on the upper surface of the second element 6 fixed in place on the housing, is then released from this element 6, at which point the breechblock stop lever 20, which us subjected to the tension of the first torsion spring 2, can dip down at the control element end, and rise up at its stop arm end (fourth direction of rotation 94).

When the trigger 50 is not pressed, the control element end of the breechblock stop lever 20 can dip down directly, and the stop arm end of the breechblock stop lever 20 can rise up until this stop arm end bears on the lower surface of the breechblock carrier 30.

When the trigger 50 is pressed, the control section 11 is rotated as the breechblock continues to move back until the second control section 13 of the control element 10 lying on the control surface 55*a* of the trigger 50 slides over the control edge 55*b* of the trigger 50 with its projection 13*a*, and is released from the actuated trigger 50, after which the breechblock stop lever 20 can assume the same position that it is in when the trigger 50 is not pressed.

Time t16: The control section 11 is moved away from the middle projection 37, toward the back, until the third control section 12 on the control element 10, which bears on the element 6, slides down over the element 6. As a result, the breechblock stop lever 20 is moved further upward, and the breechblock carrier 30 can lock in place in each of the three catches 31, 32, 33 during the backward movement.

Time t17: The breechblock carrier 30 is in the starting position. The weapon is loaded and not secured.

FIGS. 17 to 17*c* show the fully automatic firing sequence for the automatic firearm, or the trigger assembly 70 shown in FIG. 7, in nine successive points in time, t18, t19, t20, t21, t22, t23, t24, t25, and t26.

Time t18: The safety lever 60 is in its third setting, i.e. the continuous firing position. Unlike in the single shot position, the continuous firing element 40 is now no longer blocked by the safety lever 60. Only the spring force of the second torsion spring 3 that pushes the trigger 50 forward holds the continuous firing element 40 in position, counter to the spring force of the third torsion spring 4.

Time t19: The trigger 50 is actuated, and pushes the control element 10 upward. This results in a downward rotation of the breechblock stop lever, i.e. in direction 93. The continuous firing element 40 is rotated clockwise, i.e. in direction 95, by the third torsion spring 4 when the trigger 50 is actuated.

Time t20: The trigger 50 is fully actuated. The breechblock carrier 30 is released and moved forward by the force of the closing spring.

Time t21: The front projection 36 on the breechblock carrier 30 comes in contact with the control section 11, and moves it forward, i.e. in direction 92. The third control section 12 of the control element 10 passes over the element 6 at this point. Because of the eccentric design of the section 12*a* up to the projection 12*b* in the third control section 12, the breechblock stop lever 20 is moved downward at its stop arm end (direction 93), i.e. the breechblock stop lever 20 dips down further at its stop arm end. The continuous firing element 40 engages in the claw 26*b* on the breechblock stop lever 20 with its claw 46, and retains the breechblock stop lever 20 in this lower position at its stop arm end, corresponding to the standby position of the breechblock stop lever 20.

Time t22: The fully automatic firing setting is now obtained: The trigger 50 is actuated. The breechblock stop lever 20 is held in its standby position by the continuous firing element 40, and is in the lower position. The breechblock carrier 30 moves back and forth freely in the fully automatic firing mode. The control section 11 is rotated back and forth in both directions 91, 92 by the first control curve region 36, 37, 38—although the control section 11 has no function in this mode, and can swing freely.

Time t23: the fully automatic firing function is stopped. The trigger 50 is released. The breechblock carrier 30 moves forward again after reaching the rear end stop. In this snapshot, the trigger 50 is released after first catch 31 has been passed. By releasing the trigger 50, the continuous firing element 40 is rotated in the counterclockwise direction, i.e. in direction 96. As a result, the claw 46 on the continuous firing element 40 is rotated away from the claw 26*b* on the breechblock stop lever 20, and releases it.

Time t24: The breechblock moves forward for the last time. The control section 11 on the control element 10 is moved forward in the rotational direction 92 (second rotational direction). The breechblock stop lever is moved downward at its stop arm end in the direction 93.

Time t25: The breechblock returns after firing the last shot. The breechblock can be locked in place in each of the three catches 31, 32, 33, if the return is too weak.

Time t26: The starting point, like that at time t18, is now obtained.

Remarks regarding time t24: If the trigger 50 is released during the return movement of the breechblock, the breechblock stop lever 20 locks the breechblock carrier 30 in place after the buffer contact in the forward movement, and no further shots are fired. The functional sequences at times t23 and t24 no longer occur in this case, and the breechblock carrier remains retained in its front catch 31, as shown at time t26, i.e. the main catch.

Figure 18:
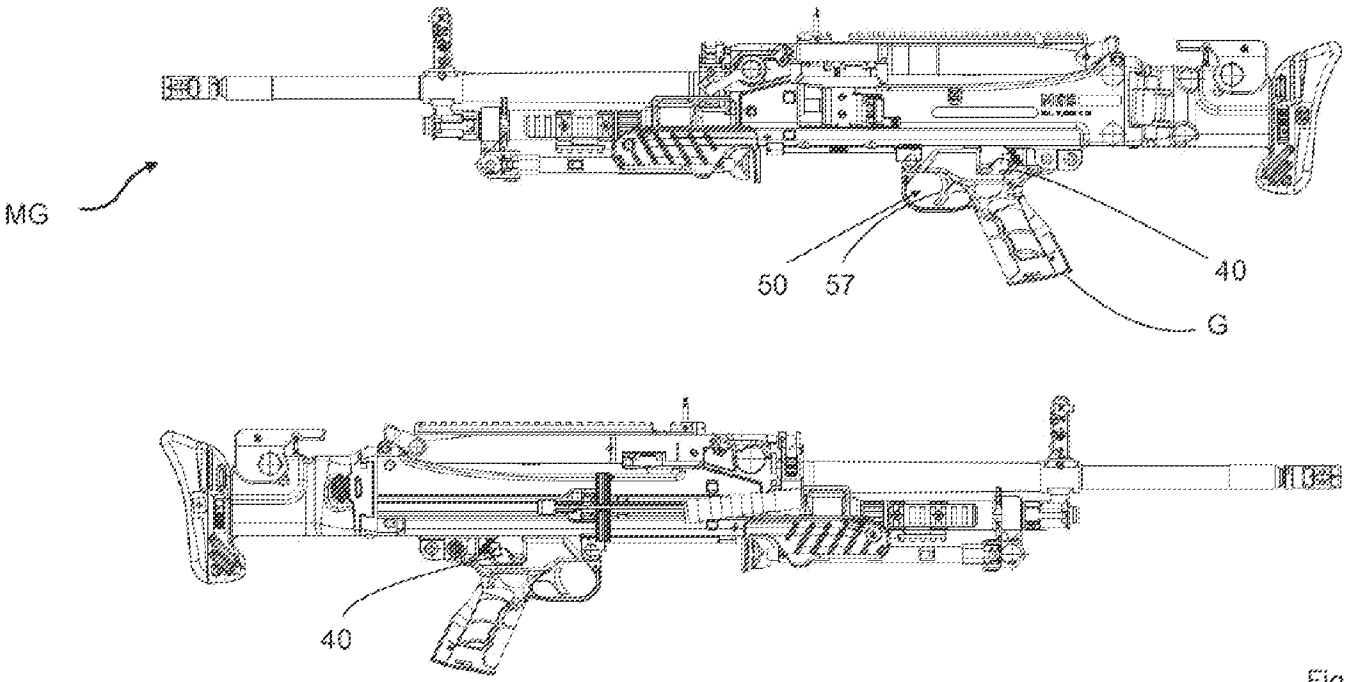
FIG. 18 shows an automatic weapon with the trigger assembly from FIG. 7 and the breechblock from FIG. 4.

FIG. 18 shows an automatic weapon MG, model MG5, with the trigger assembly 70 and the breechblock carrier 30 described above. The MG5 is an indirect gas-operated reloader, with a caliber of 7.62×51 mm. The weapon is shown in a side view, in which some of the structural details of the example are hidden by the handle G. The actuating element 57 for the trigger 50 can be seen. So can the safety or firing selection lever 60. The safety or firing selection lever 60 can be operated ambidextrously.

There is no need to go into further design features of the automatic machine gun MG5 in the framework of this disclosure, as they are not substantial to the examples disclosed herein. The examples disclosed herein are not limited to a specific type of automatic weapon, and instead can be used with numerous different automatic weapons. In particular, existing automatic weapons can be retrofitted with the trigger assembly described above, and with the breechblock carrier described above.

Based on the above, at least one goal of some of the disclosed examples is to create an improved control element. It is also a goal of some of the disclosed examples to create an improved breechblock stop lever. It is also a goal of some of the disclosed examples to create an improved breechblock carrier. It is also a goal of some of the disclosed examples to create an improved trigger. Moreover, it is also a goal of some of the disclosed examples to create an improved trigger assembly. It is also a goal of some of the disclosed examples to create an automatic weapon with any of the aforementioned components. As such, an automatic weapon should be obtained in particular, which allows for the settings "safety on," "single shot," and "fully automatic firing" as well as loading of the firearm when the safety is on, with at least one of the aforementioned components.

These goals are achieved through the subject matter set forth in the examples herein.

According to a first aspect, there is a control element for controlling a breechblock stop lever that can move about a first axis of rotation, wherein the breechblock stop lever can be moved between a standby position for releasing a breechblock carrier and a retaining position in which the breechblock carrier is held in place. The control element has a first arm that can pivot about a second axis of rotation.

A first arm comprises a first control section that has a first contact surface and a second contact surface facing away from the first contact surface, which can be deflected about the second axis of rotation for the control element by means of a control curve on the breechblock carrier.

In other words, the first control section comprises contact surfaces on its front and back sides, each of which can be controlled by the control curve located on the lower surface of the breechblock carrier. A controlling of the control element by the control curve results in a deflection (also referred to as a turning) of the control element about its own axis of rotation. If the control element is activated when the breechblock slides forward, it then turns in one of two directions of rotation toward the front. The deflection toward the rear corresponds to a first rotation, while the deflection toward the front corresponds to a second rotation about the second axis of rotation.

The first arm also comprises a second control section that can be activated by means of a control surface on a trigger. The second control section, which is located in particular on a lower surface of the first arm, can be brought into contact with the control surface on the trigger, when the trigger is squeezed, to trigger, or release, the breechblock stop lever.

After releasing the breechblock stop lever on the breechblock carrier, the example control element disclosed herein can retain the breechblock stop lever in its standby position while the breechblock carrier moves forwards, and release the breechblock stop lever when the breechblock carrier slides backward. Furthermore, the second control section can "slide" over the control edge on the trigger when the stop lever is released, such that the control element is then moved from a pivoted or twisted position, resulting from the movement of the breechblock carrier when it is moving backward, to a starting position.

If the second control section "slides" over the control edge of the trigger, a spring element that presses the breechblock stop lever into its retaining position then triggers a "downward" movement of the control element.

The control element can be understood in particular to be a type of coupling element, which couples the trigger in a trigger assembly to the breechblock stop lever. The control element can be controlled in a trigger assembly by the trigger via the control surface and by the breechblock carrier via the control curve. In other words, the control element can be controlled from "below," and from "above."

The control element is rotated when it is controlled by the control curve on the breechblock carrier, and the second axis of rotation preferably moves in a purely vertical direction when it is activated by the trigger. In other words, when the trigger is actuated, it pushes or shoves the second axis of rotation, and therefore the control element, upward by means of its control surface.

The functions, or settings, "safety on," "single shot," and "fully automatic firing" as well as a continuous loading of the automatic weapon can be enabled by means of the control element according to the examples herein, when the automatic weapon is in the secured state.

The control element can form a control lever that can be pivoted, i.e. rotated, in particular in relation to the first axis of rotation for the breechblock stop lever, parallel to the axis thereof.

To attach the control element to the breechblock stop lever, the control element can have a hole that is coaxial to the second axis of rotation, for receiving a fastening element, e.g. a pin, rod or bolt. If the hole is in the form of a single bore-hole, a single fastening element is sufficient. If instead, the hole is formed by two blind holes, one on each end, then two fastening elements are necessary.

In one example, the control element comprises a second arm, axially spaced apart from the first arm, which comprises a third control section that can be functionally connected to a first component on the housing in order to brace against a torque.

When the trigger is actuated, and the breechblock moves forward after it has been released by the breechblock stop lever, the third control section moves toward an element connected to the housing of the handle, and braces against this element during the entire forward movement of the breechblock.

Such a third control section that can brace against an element prevents the breechblock stop lever from catching in a notch, or in an intermediate position, on the breechblock carrier if the actuated trigger is prematurely released (intentionally or unintentionally) while the breechblock is moving forward. If the breechblock carrier catches while moving forward, it must then be manually pulled back to its starting position.

In other words, the third control section on the second arm of the control element slides over the element on the housing, and retains the breechblock stop lever in its standby position while the breechblock is moving forward, even if the trigger is released during the forward movement of the breechblock carrier.

In one example, the second control section lies radially opposite the first control section, and comprises a radial projection, which can be controlled by means of the control surface on the trigger.

The radial projection allows for a better control by the control surface on the trigger, in particular if the control surface on the trigger has a control edge. If the trigger is actuated, and the breechblock carrier moves backward, the second control section is reliably "slid" over the control edge by means of the radial projection.

To increase the reliability of the sliding down of the radial projection, it may be preferred that the radial projection tapers to a point, and forms an edge that is parallel to the second axis of rotation.

In another example, the first arm has a cross section that tapers radially outward in the region of the first control section. A control element that narrows toward the top allows for a more precise control of the control curve on the breechblock carrier. This also allows for a "finely adjusted" control curve on the breechblock carrier.

This effect can be increased if the first arm is stepped at an end surface such that the first arm becomes thinner in the axial direction in the region of the first control section. This results, in other words, in a reduction in the longitudinal section. If there is a second arm, the end surface of the first arm facing away from the second arm may be the end that is stepped.

In another example, the third control section preferably has a second radial projection, which is preferably eccentric or curved, and forms, in particular, the lower end of the second arm, or the third control section. An eccentric or curved radial projection, preferably extending downward toward the trigger, enables a reliable bracing of the third control section against a component on the housing. The reliable bracing on the housing component results in turn in a reliable retaining of the breechblock stop lever in the standby position while the trigger is actuated, and the breechblock is moving forward.

In another example, the second arm has a projection extending radially, in particular a claw, on which a contact surface is formed facing the direction of rotation of the control element, wherein the projection is preferably formed on an end surface of the second arm facing away from the first arm.

Such a projection allows for the formation of a contact surface that does not impair control by the breechblock carrier or the trigger. A projection directed axially outward can advantageously come to bear on corresponding stop or contact surfaces on the breechblock stop lever in both rotational directions of the control element about the second axis of rotation.

Such an axially extending projection is then preferably used when the control element is supported axially inside two fastening arms on the breechblock stop lever with regard to the first axis of rotation for the breechblock stop lever, and only the axial projection extends into the plane of one of the two fastening arms formed by a longitudinal section.

In another example, there may be a middle piece between the first arm and the second arm, which forms, along with the arms, an annular gap that runs at least in part about the second axis of rotation, in which a leg of a spring can be brought into contact with the middle piece.

To ensure that the control element rotates in a controlled manner about its own axis of rotation, the control element is also coupled with the breechblock stop lever by means of a spring element. The control element has a space for this, located axially between the first and second arms, e.g. in the form of an annular gap, in which a part of the spring element can come to bear. In a structurally simple example, a torsion spring is wound about the first axis of rotation for the breechblock stop lever, and clamped with both legs in the annular gap such that a force is constantly exerted that retains the control element in its middle position. The middle position is approximately in the middle, between the forward deflection and the backward deflection. As a result, the spring force must be overcome in order for the element to rotate in either the first or second direction. If the control element is deflected, the spring force of the spring element pushes the control element back into the middle position.

The second arm may have a second radial projection, which forms a lateral stop that guides the spring element, in particular the torsion spring, in the annular gap. In other words, the later stop prevents the spring element from sliding out of the annular gap while the weapon is in operation.

According to a second, there is a breechblock stop lever for retaining and releasing a breechblock carrier, wherein the breechblock stop lever can pivot about a first axis of rotation, and has a stop arm for retaining the breechblock carrier.

It is distinguished in that it has two fastening arms that substantially extend radially to the first axis of rotation for receiving a control element that has a second axis of rotation, wherein the two fastening arms are preferably parallel to one another.

In order to support the control element such that it can rotate about the fastening arms, there is a hole on each end of the respective fastening arms, e.g. in the form of a bore-hole, for receiving a fastening element, e.g. a pin, rod, or bolt. The holes in the fastening arms correspond to the holes in the control element.

In a further development of the breechblock stop lever, one of the two fastening arms, in particular the second fastening arm, has two stops, each of which has a stop surface, which can be brought into contact with the axial projection on the control element. The two stops are placed such that a first stop limits the rotation of the control element in the first direction of rotation, caused by the breechblock carrier, and a second stop limits the rotation of the control element in a second direction of rotation, caused by the breechblock carrier.

The stops can be formed by the removal of material in the second fastening arm. In particular, the removal of material can at least in part form a ring, seen longitudinally, i.e. a surface with two concentric circles. The material removal preferably describes at least a C-shaped ring, at least in part. Accordingly, bearing surfaces are formed "in front of" and "behind" the second axis of rotation. These bearing surfaces are also formed on the lower surface of the second fastening arm. The lower surface is the side facing away from the breechblock carrier, or the side facing toward the trigger. This material removal enables a substantially circular rotation of the axial projection about the second axis of rotation.

In another example, the stop arm is formed by two stop arm sections extending in the opposite direction of the fastening arms, wherein the stop arm sections form a stopping surface on their respective ends.

Two stop arm sections have the advantage over just one stop arm section in that, starting from the first axis of rotation, a longitudinal space or gap is formed between the two stop arm sections. The control curve can advantageously "dip into" this space with its projections, and thus pass by the stop arm with its axially spaced apart stop arm sections. This is particularly important if the breechblock stop lever is pushed upward, in particular by its torsion spring, when the breechblock returns, and the spacing between the control curve, or the projection forming the control curve, and the stop arm is reduced.

To increase the strength of the stop arm sections, the respective stop arm sections are preferably connected to one another at their respective ends by a web. The web is preferably placed such that it can also pass by the control curve without coming in contact therewith. This can take place in that the web forms an opening with the ends of the stop arm sections directed toward the lower surface of the breechblock carrier, wherein the opening has, in particular, a semi-circular, U-shaped, rectangular, or V-shaped cross section. The control curve can pass by these geometries without coming in contact therewith, in particular during the return of the breechblock.

In order to be able to hold down or lock the breechblock stop lever in place with a continuous firing element, the breechblock stop lever has a claw, which may be located on a side of a first stop arm section facing away from the breechblock carrier.

According to a third aspect, there is a breechblock carrier for a breechblock that can move longitudinally in an automatic weapon. The breechblock carrier is distinguished in that it has a control curve on its lower surface for controlling a rotating control element on a breechblock stop lever for retaining and releasing the breechblock carrier.

Such a breechblock carrier move freely back and forth, interacting with a control element such as that described above, because the control element releases the breechblock stop lever in its retaining position (when the breechblock returns) and holds it in its standby position (when the breechblock moves forward) through the control of the breechblock carrier.

A breechblock carrier in which the control curve is formed by at least one projection extending in the radial direction of the longitudinal axis is preferred. It has proven to be particularly advantageous to have at least two, preferably three radially extending projections, which are arranged sequentially in the longitudinal direction of the breechblock carrier, such that an empty space is formed between the projections.

The projection can have a rectangular cross section. A length of the projection can be greater than its width. The length to width ratio of the project is preferably greater than 2:1, more preferably greater than 3:1, and particularly preferably greater than 4:1.

There can be numerous projections, e.g. two, three, four, or five projections. Three radially extending projections are particularly preferable, which are then arranged successively in the axial direction.

Numerous successive projections makes it possible, for example, to have numerous catches, in which the breechblock stop lever can lock in place when pulling back the breechblock. The first control section of the control element can enter the empty spaces between the projections in an advantageous manner, e.g. in the event of disruptions and breechblock blockings when the breechblock is moving forward during the manual return of the breechblock necessary for removing these disruptions, after releasing the trigger, and during the return of the breechblock.

The breechblock carrier may have at least one catch, which is divided into left and right catch sections by at least one recess extending in the longitudinal direction, in particular a groove.

The groove is placed such that the first control section on the first arm of the control element can enter it. In other words, the first control section extends into the groove and passes by the catch section without touching it, i.e. without coming in contact therewith.

The empty spaces on the projections and the at least one groove have the same function, specifically of giving enough space for the first control section during the manual return of the breechblock.

If there are numerous catches, it is then the projections forming the control curve may be placed at appropriate spacings to the respective catches. The result is that the at least one groove is interrupted by one of the projections, such that there are then three grooves for three catches, in order to ensure a reliable locking in place, in particular of the first and second stop arm sections of the breechblock stop lever in all three catches that are moved backward.

A breechblock carrier that has three projections and three catches is a particular example, in which a first and second projection are placed in front of the three catches in the longitudinal direction of the breechblock carrier, and a third projection is placed between two catches in the longitudinal direction. Such a breechblock carrier makes it possible to control the control element or the first control section, and also enables locking in place in three positions while still obtaining a compact breechblock carrier.

According to a fourth aspect, there is a trigger for controlling a control element in a trigger assembly for an automatic weapon. The trigger can move between a non-actuated position and an actuated position, and comprises an element that can pivot about a fourth axis of rotation.

The trigger is characterized by a projection extending axially from the element, wherein the projection has a control surface that faces upward, which can be brought in contact with a corresponding control section of the control element to move the control element from a first position to a second, and wherein the projection has a control edge that is substantially parallel to the fourth axis of rotation.

Such a trigger can control the control element, i.e. moving it from a first position, substantially vertically, to a second position, and the actuated trigger can also allow the control element to "slide down" over the control edge, after the control element has been deflected by the return of the breechblock.

A trigger with a control surface profile that has a concave cross section is preferred. The concave shape makes it easier to control the control element that is to be moved.

According to a fifth aspect, there is a trigger assembly for an automatic weapon. The trigger assembly comprises a control element such as that described above, a breechblock stop lever such as that described above, and a trigger such as that described above.

A trigger assembly can be obtained with these components that can be controlled by a breechblock carrier. Such a trigger assembly, interacting with a breechblock carrier that has a corresponding control curve, enables continuous loading in the secured state and the settings, "single shot," and "fully automatic firing." The breechblock carrier can be the breechblock carrier described above, in particular.

The trigger can pivot about a fourth axis of rotation, and is configured to control the control element, in particular the second control section of the control element. The trigger has a control surface for this, which moves the second control section upward when the trigger is actuated. The upward movement of the second axis of rotation results in a downward turning of the first and second stop arm sections, i.e. the breechblock stop lever is moved into its standby position. In other words, an activation of the control element by means of the trigger results in a rotation of the breechblock stop lever about the first axis of rotation for the breechblock stop lever.

The perpendicular control element that is moved upward can then be controlled by the breechblock carrier with the control curve such that the control element can exert a torque on the breechblock stop lever in order to hold the breechblock stop lever in its standby position, and also to move it further into its standby position.

If the perpendicular control element that has been moved upward is controlled by the breechblock carrier with its front control curve when the breechblock moves forward, the third control section slides the second arm of the control element over the second element on the housing, as described above, and retains the breechblock stop lever in its standby position throughout the entire forward movement of the breechblock, even if the trigger were to be released during the forward movement of the breechblock carrier.

The trigger assembly also comprises a continuous firing element and a safety, wherein the safety secures the trigger in a first setting, and releases the trigger and secures the continuous firing element in a second setting, and releases both the trigger and the continuous firing element in a third setting. The continuous firing element encompasses a third axis of rotation. If the safety forms a safety lever, it can then pivot about a fifth axis of rotation.

The five axes of rotation, specifically the first axis of rotation for the breechblock stop lever, the second axis of rotation for the control element, the third axis of rotation for the continuous firing element, the fourth axis of rotation for the trigger, and the fifth axis of rotation for the safety lever, are preferably parallel to one another, resulting in the following sequence when seen longitudinally from the front: fourth axis of rotation, second axis of rotation, first axis of rotation, third axis of rotation, and fifth axis of rotation.

The control element, breechblock stop lever, trigger and continuous firing element are each subjected to a spring force which can be provided in particular by springs in the form of torsion springs. The torsion springs are wound around axes of rotation formed on the handle housing or about elements or stops. There are preferably three elements for torque bracing of the torsion springs.

A first torsion spring is preferably braced against a first element with its first leg and presses with its second leg against the breechblock stop lever (torsion spring for the breechblock stop lever). The first torsion spring is wound around a third element.

A second torsion spring is braced against a second element with its first leg and presses against the trigger with its second leg (torsion spring for the trigger). The second torsion spring is also wound around the third element.

A third torsion spring is braced against the first element with its first leg and presses against the continuous firing element with its second leg. The so-called "torsion spring for the continuous firing element" is wound around the third axis of rotation and results in a torque toward the back, i.e. in the clockwise direction. In particular, the winding of the torsion spring about the third axis of rotation is understood to mean that the inner diameter of the torsion spring lies on a sleeve region of the continuous firing element, i.e. not directly on the axle.

The force of the first torsion spring (torsion spring for the breechblock stop lever) is greater than the force of the second torsion spring (torsion spring for the trigger), and the force of the second torsion spring is greater than the force of the third torsion spring (torsion spring for the continuous firing element).

A fourth torsion spring is wound around the first axis of rotation and holds the control element in a middle position (torsion spring for the control element). The control element can be pivoted about the second axis of rotation in both directions, counter to the spring force of the fourth torsion spring.

The components of the trigger assembly are located in a handle housing. The handle housing forms a non-rotating component.

In one example the control element can rotate between two positions on the breechblock stop lever about the second axis of rotation. The first axis of rotation for the breechblock stop lever is also connected to a non-rotating component, in particular the handle housing, such that the control element can rotate about its own axis of rotation, and also on the axis of rotation for the breechblock stop lever.

It may be preferred that the trigger assembly has an element connected to a non-rotating component for guiding the third control section. Such an element, which can also be referred to as an insert or stop, can be used to brace a torque of the third control section, in particular the radial projection. In an advantageous example, the element and the insert or stop are the same component.

According to a fourth aspect, there is an automatic weapon that has a trigger assembly such as that described above and a breechblock carrier such as that described above. Such a weapon allows for continuous loading in the secured state and the settings, "safety on," "single shot," and "fully automatic firing."

Further examples can be derived by the person skilled in the art from the following claims and the attached drawings.

The invention claimed is:

1. A trigger assembly for an automatic weapon, comprising:

a control element for controlling a breechblock stop lever that can move about a first axis of rotation, which can be moved between a standby position for releasing a breechblock carrier and a retaining position for retaining the breechblock carrier, the control element including:

an arm that can rotate about a second axis of rotation;

a first control section on the arm, the first control section including a first contact surface and a second contact surface facing away from the first contact surface, which can be rotated about the second axis of rotation for the control element by a control curve on the breechblock carrier; and a second control section on the arm, wherein the second control section can be controlled by a control surface on a trigger;

a breechblock stop lever that includes a stop arm for retaining the breechblock carrier, the breechblock stop lever including:

a first fastening arm extending substantially radially in relation to the first axis of rotation;

a second fastening arm extending substantially radially in relation to the first axis of rotation, wherein the first and second fastening arms are for receiving a control element that includes a second axis of rotation; and a trigger including:

a main body that can pivot about an axis of rotation;

a projection extending axially away from the main body, a control surface that faces upward on the projection, wherein the control surface can be brought in contact with a corresponding control section on the control element for moving the control element from a first position to a second position, and a control edge on the projection, wherein the control edge is substantially parallel to the axis of rotation, which allows the control element to rotate about its own axis of rotation when the trigger is actuated;

wherein the control element can be controlled by a breechblock carrier that includes a control curve, such that the control element holds the breechblock stop lever in its standby position while the breechblock carrier moves forwards, and releases the breechblock stop lever in its retaining position while the breechblock carrier returns.

2. The trigger assembly according to claim 1, wherein the control element is supported on the breechblock stop lever such that it can rotate about the second axis of rotation between two positions, and the first axis of rotation for the breechblock stop lever is connected to a non-rotating component, in particular a handle housing, such that the control element can rotate about its own axis of rotation and about the axis of rotation for the breechblock stop lever.

3. The trigger assembly according to claim 1, wherein, when the control element is controlled by means of the control surface on the trigger, the control element rotates about the first axis of rotation for the breechblock stop lever.

4. The trigger assembly according to claim 1, wherein the trigger assembly includes an element connected to a non-rotating component for guiding a third control section.

5. The trigger assembly according to claim 1, wherein there are a continuous firing element and a safety, wherein the safety secures the trigger in one setting, releases the trigger and secures the continuous firing element in a second setting, and releases both the trigger and the continuous firing element in a third setting.

6. An automatic weapon comprising:

a control element for controlling a breechblock stop lever that can move about a first axis of rotation, which can be moved between a standby position for releasing a breechblock carrier and a retaining position for retaining the breechblock carrier, the control element including:

an arm that can rotate about a second axis of rotation;

a first control section on the arm, the first control section including a first contact surface and a second contact surface facing away from the first contact surface, which can be rotated about the second axis of rotation for the control element by a control curve on the breechblock carrier; and a second control section on the arm, wherein the second control section can be controlled by a control surface on a trigger;

a breechblock stop lever that includes a stop arm for retaining the breechblock carrier, the breechblock stop lever including:

a first fastening arm extending substantially radially in relation to the first axis of rotation;

a second fastening arm extending substantially radially in relation to the first axis of rotation, wherein the first and second fastening arms are for receiving a control element that includes a second axis of rotation; and a trigger including:

a main body that can pivot about an axis of rotation;

a projection extending axially away from the main body, a control surface that faces upward on the projection, wherein the control surface can be brought in contact with a corresponding control section on the control element for moving the control element from a first position to a second position, and a control edge on the projection, wherein the control edge is substantially parallel to the axis of rotation, which allows the control element to rotate about its own axis of rotation when the trigger is actuated;

wherein the control element can be controlled by a breechblock carrier that includes a control curve, such that the control element holds the breechblock stop lever in its standby position while the breechblock carrier moves forwards, and releases the breechblock stop lever in its retaining position while the breechblock carrier returns.

* * * * *